US009920976B2

(12) United States Patent
Lee et al.

(10) Patent No.: US 9,920,976 B2
(45) Date of Patent: Mar. 20, 2018

(54) DEHUMIDIFIER AND WATER TANK FOR A DEHUMIDIFIER

(71) Applicant: LG ELECTRONICS INC., Seoul (KR)

(72) Inventors: Jongsu Lee, Seoul (KR); Jonhoun Yoo, Seoul (KR); Ilsoo Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 285 days.

(21) Appl. No.: 14/698,986

(22) Filed: Apr. 29, 2015

(65) Prior Publication Data

US 2015/0308732 A1 Oct. 29, 2015

(30) Foreign Application Priority Data

Apr. 29, 2014 (KR) ..... 10-2014-0051927

(51) Int. Cl.

| | |
|---|---|
| ***F25D 21/14*** | (2006.01) |
| ***F24F 3/14*** | (2006.01) |
| ***F24F 13/20*** | (2006.01) |
| ***F24F 13/22*** | (2006.01) |
| *F24F 6/00* | (2006.01) |

(52) U.S. Cl.

CPC ..... *F25D 21/14* (2013.01); *F24F 3/14* (2013.01); *F24F 3/1405* (2013.01); *F24F 13/20* (2013.01); *F24F 13/22* (2013.01); *F24F 2003/144* (2013.01); *F24F 2003/1446* (2013.01); *F24F 2006/008* (2013.01); *F24F 2221/12* (2013.01)

(58) Field of Classification Search

CPC .. F24F 1/02; F24F 1/025; F24F 3/1405; F24F 2003/1446; F24F 2221/12; F25D 21/14; A47B 95/02; A47B 2095/022; A47B 2095/027; A47B 2220/0047; E05B 1/0015; Y10T 16/4644; Y10T 16/4554; Y10T 16/473; B65D 2525/287

See application file for complete search history.

(56) References Cited

U.S. PATENT DOCUMENTS 3,533,541 A * 10/1970 Rose ..... A47B 95/02 206/565
5,317,795 A * 6/1994 Bolton ..... A47B 95/02 16/429

(Continued)

FOREIGN PATENT DOCUMENTS

CN 1880859 12/2006
CN 1987277 6/2007

(Continued)

OTHER PUBLICATIONS

European Search Report dated Oct. 12, 2015.
Chinese Office Action dated Jun. 2, 2017 issued in Application No. 201510176579.1.

*Primary Examiner* — Christopher R Zerphey
(74) *Attorney, Agent, or Firm* — KED & Associates, LLP

(57) ABSTRACT

A dehumidifier and a water tank for a dehumidifier are provided. A withdrawable handle is provided on the water tank, which collects condensed water, and thus, when the water tank is mounted, the water tank is mounted in a state in which the handle is inserted, and when the water tank is withdrawn or moved, the handle is withdrawn, improving convenience in use.

21 Claims, 21 Drawing Sheets

(56) References Cited

U.S. PATENT DOCUMENTS

| | | | | |
|---|---|---|---|---|
| 5,901,565 | A * | 5/1999 | Morton, Jr. | F24F 3/1405<br>165/103 |
| 7,140,703 | B1 * | 11/2006 | Holdgate, III | A47B 88/60<br>312/323 |
| 7,891,206 | B2 * | 2/2011 | Yoon | F24F 3/14<br>220/23.87 |
| 2006/0278085 | A1 * | 12/2006 | Kim | B01D 53/261<br>96/140 |
| 2010/0236279 | A1 * | 9/2010 | Eom | F25D 23/021<br>62/449 |
| 2016/0334118 | A1 * | 11/2016 | Ahn | F24F 3/1405 |

FOREIGN PATENT DOCUMENTS

| | | |
|---|---|---|
| CN | 200965334 | 10/2007 |
| CN | 101178228 | 5/2008 |
| CN | 101548137 | 9/2009 |
| CN | 202177173 | 3/2012 |
| CN | 202254003 | 5/2012 |
| CN | 203454275 | 2/2014 |
| JP | 2004/061042 | 2/2004 |
| JP | 2007/253138 | 10/2007 |
| KR | 10-2005-0083417 A | 8/2005 |
| KR | 10-2013-0138478 A | 12/2013 |

* cited by examiner

DEHUMIDIFIER AND WATER TANK FOR A DEHUMIDIFIER

CROSS-REFERENCE TO RELATED APPLICATION(S)

The present application claims priority under 35 U.S.C. 119 and 35 U.S.C. 365 to Korean Patent Application No. 10-2014-0051927, filed in Korea on Apr. 29, 2014, which is hereby incorporated by reference in its entirety.

BACKGROUND

1. Field

A dehumidifier and a water tank for a dehumidifier are disclosed herein.

2. Background

In general, a dehumidifier is an apparatus that suctions wet humid air within an indoor space into a case and allows the air to pass through a heat exchanger including a condenser and an evaporator, thereby reducing humidity. Then, the dehumidified air may be discharged again into the indoor space to reduce the humidity within the indoor space.

That is, a dehumidifier may absorb heat from surrounding air by evaporating a liquid refrigerant in the evaporator. The evaporator may decrease in temperature while the refrigerant is evaporated, and thus, the air passing through the evaporator may also decrease in temperature. Thus, as the surrounding air of the evaporator decreases in temperature, moisture contained in the air may be condensed to form dew on a surface of the evaporator. Thus, the dehumidified air may be discharged into the indoor space, reducing the humidity within the indoor space.

In recent years, large-scale and multifunctional dehumidifiers have been developed to improve dehumidifying performance and user convenience. Thus, high-capacity and large-scale humidifiers are greatly advantageous.

A dehumidifier in which a lower portion of an evaporator has a basket shape to collect and store condensed water is disclosed in Korean Patent Publication No. 10-2005-0083417, which is hereby incorporated by reference. In the dehumidifier having the above-described structure, if a preset or predetermined amount or more of water is collected in the basket, a user may withdraw the basket and discard the water within the basket and then remount the basket.

In the above-described related prior art, as the dehumidifier increases in capacity, the basket may increase in size. Thus, there is an inconvenience in use in that the user has to grasp the water tank using two hands because a handle structure for easily moving the dehumidifier to discard water within the basket is not provided.

Also, a structure of a dehumidifier in which a water tank is mounted on a recessed water tank mounting portion of a main body, and the water is withdrawn in a state in which the water tank rotates by manipulation of a water tank handle disposed on a front surface of the water tank is disclosed in Korean Patent Publication No. 10-2013-0138478, which is hereby incorporated by reference. In the above-described prior art, although the handle is provided on the water tank, the handle is exposed to or at a front surface of the humidifier deteriorating an outer appearance of the dehumidifier, as well as is disposed to lean forward. Thus, when the water tank is lifted, the water tank may tilt, spilling water.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. The technical scope will fall within the scope of this disclosure, and addition, deletion, and modification of components or parts are possible within the scope of the embodiments.

Figure 1:
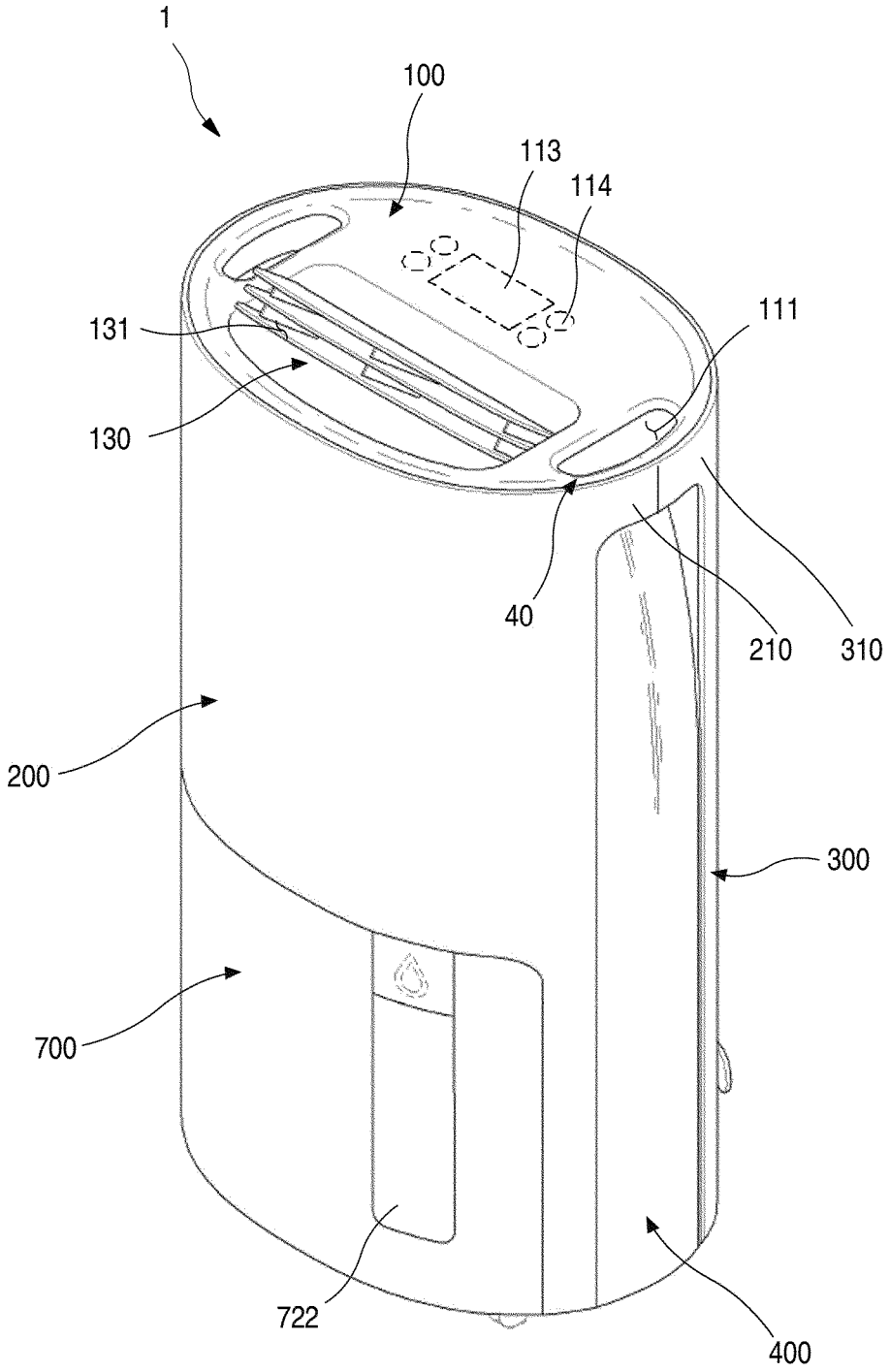
FIG. 1 is a front perspective view of a dehumidifier according to an embodiment.
Figure 2:
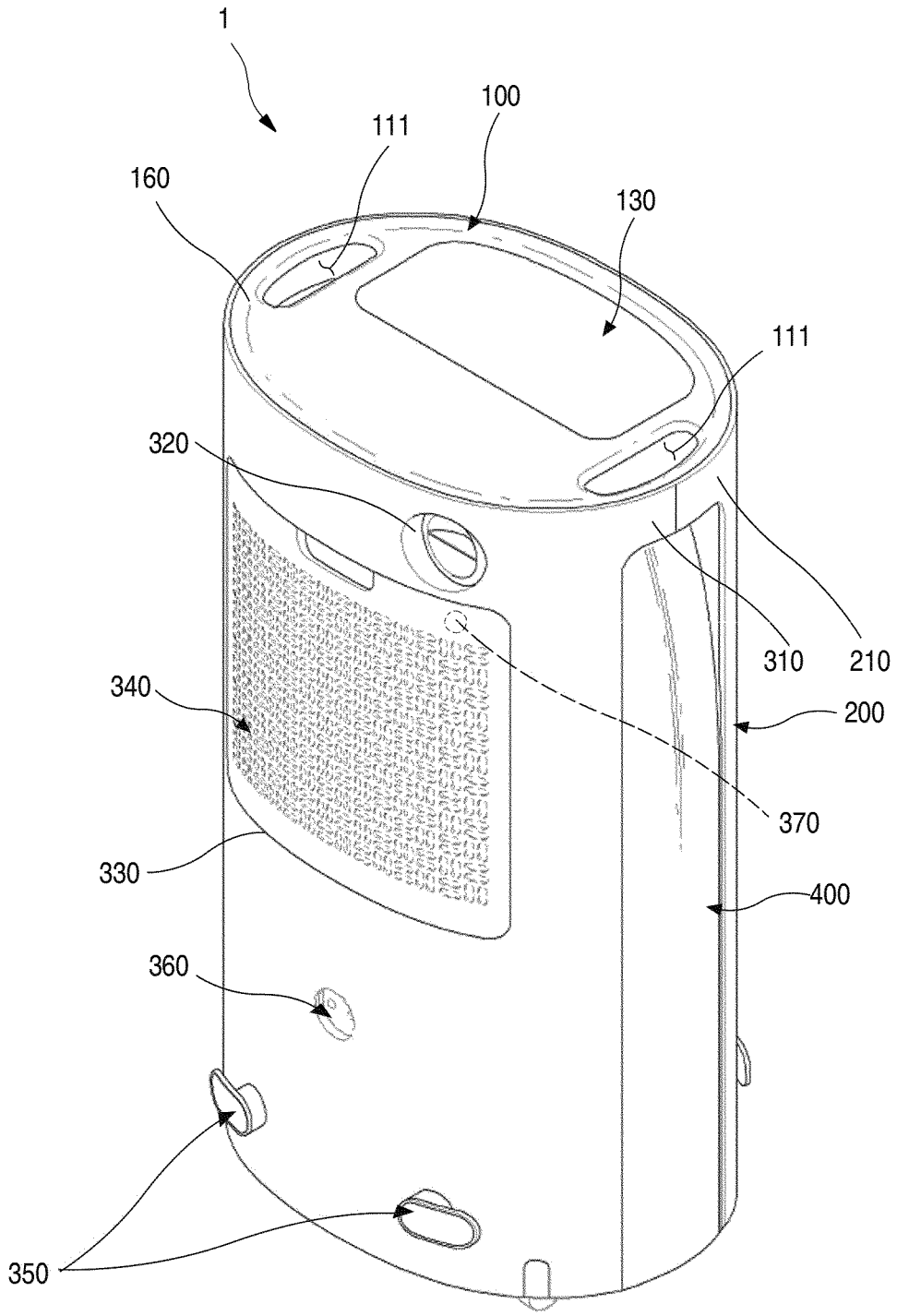
FIG. 2 is a rear perspective view of the dehumidifier of FIG. 1.
Figure 3:
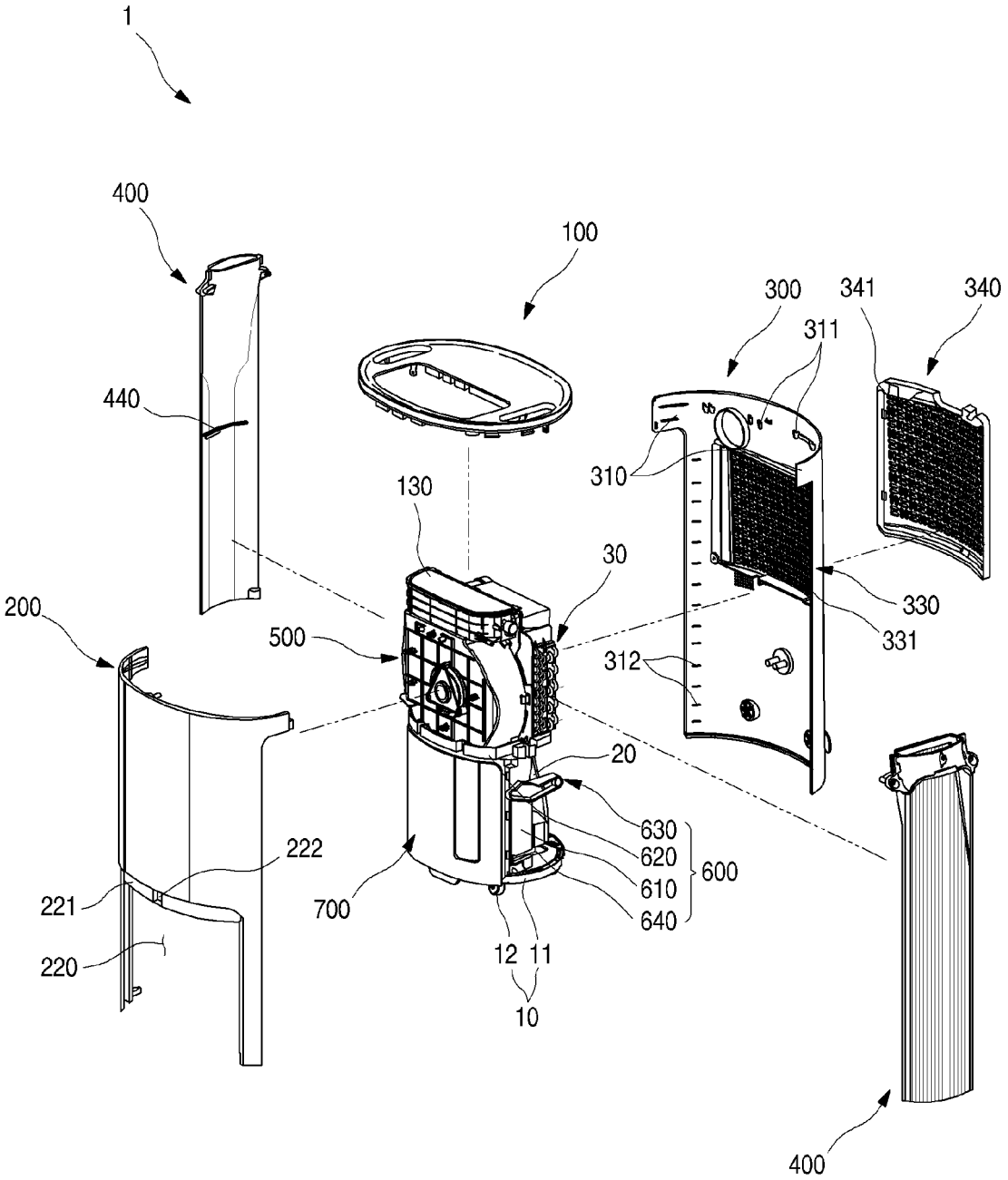
FIG. 3 is an exploded perspective view of the dehumidifier of FIG. 1.

FIG. 1 is a front perspective view of a dehumidifier according to an embodiment. FIG. 2 is a rear perspective view of the dehumidifier of FIG. 1. FIG. 3 is an exploded perspective view of the dehumidifier of FIG. 1.

Referring to FIGS. 1 to 4, a main body defining a dehumidifier 1 according to an embodiment may have a generally circular cross-section when viewed from an upper side and a cylindrical shape having a predetermined height. The dehumidifier 1 may have an outer appearance defined by a top cover assembly or top cover 100 that defines a top surface, a base pan assembly 10 that defines a bottom surface, front and rear cases 200 and 300 that defines front and rear surfaces, and a side deco 400 that defines a portion of each of both side surfaces.

In detail, the top cover 100 may define a top surface of the dehumidifier 1 and may have an oval shape. A handle hole 111, into which a hand of a user may be inserted to grasp the dehumidifier 1 to move the dehumidifier 1, may be defined in each of both sides of the top cover 100.

A louver 130 may be disposed at a front portion of the top cover 100. The louver 130 may have a plurality of discharge holes 131, through which air dehumidified within the dehumidifier 1 may be discharged. The louver 130 may be rotatably mounted on the top cover 100. Thus, the louver 130 may rotate to expose or open the plurality of discharge holes 131 when the dehumidifier 1 operates. On the other hand, when the dehumidifier 1 does not operate, the louver 130 may rotate not to expose or close the plurality of discharge holes 131. Thus, when dehumidifier 1 does not operate, the louver 130 may form or lie in a same plane as the top cover 100, defining the outer appearance of the top surface of the dehumidifier 1. The louver 130 may be rotated by a motor 132. When the dehumidifier 1 operates, the louver 130 may automatically rotate to open the plurality of discharge holes 131, thereby adjusting a discharge direction of the dehumidified air.

A manipulation part or manipulator 151 (see FIG. 5) may be disposed under the top cover 100. The manipulator 151 may be manipulated by a user to manipulate the dehumidifier 1. The manipulator 151 may be provided at a rear space or portion of the louver 130. The manipulator 151 may be manipulated by a user and confirmed through the top surface of the top cover 100. The manipulator 151 may include a capacitive-type touch sensor, a button, or a switch, for example. Also, a display 152 to display an operation state of the dehumidifier 1 may be further disposed at one side adjacent to the manipulator 151.

The base pan assembly 10 may include a base pan 11 that defines the bottom surface of the dehumidifier 1, and one or more wheel 12 mounted on the base pan 11. The base pan 11 may provide a surface on which a compressor 20, which may be a main component of the dehumidifier 1, and a plurality of other components may be disposed. For this, a plurality of reinforcing ribs that crosses each other may be disposed on the base pan 11 to prevent the base pan 11 from being deformed or damaged even though the plurality of components are mounted on the base pan 11. The base pan 11 may have an oval shape to correspond to the shape of the top cover assembly 100.

The wheel 12 may be disposed on a bottom surface of the base pan 111 to allow the dehumidifier 1 to easily move. In particular, when a user grasps a handle 40 of the dehumidifier 1 to move the dehumidifier 1, the wheel 12, which may be shaft-coupled to the bottom surface of the base pan 11, may rotate in a moving direction so that the user may easily push or pull the dehumidifier 1.

A base roller (see reference numeral 13 of FIG. 17) may be disposed on a front end of a top surface of the base pan 11. The base roller 13 may contact a bottom surface of a tank drawer 710 and then roll when the tank drawer 710, in which a water tank 800 may be accommodated, is withdrawn forward. When the tank drawer 710 is completely withdrawn, a weight center of the tank drawer 710 may be defined at a relatively front side when compared to the base roller 13. Thus, the tank drawer 710 may be tilted.

The front case 200 and the rear case 300 may define front and rear outer appearances of the dehumidifier 1. The front case 200 and the rear case 300 may be formed of plate-shaped materials and coupled to bottom surfaces of the top cover 100 and the base pan 11, respectively. Thus, the front case 200 and the rear case 300 may have curvatures corresponding to circumferences of the top cover 100 and the base pan 11, respectively.

A front extension 210 that extends backward may be disposed on each of both first and second sides of an upper end of the front case 200. The front extension 210 may contact a rear extension 310 of the rear case 300 to connect the front case 200 to the rear case 300. Also, the front extension 210 may be coupled along a circumference of the top cover 100.

Also, a tank mount 220, on or at which the water tank assembly 700 may be disposed, may be disposed below the front case 200. The tank mount 220 may be opened in a shape corresponding to a shape of the tank drawer 710 of the water tank assembly 700. A step 221 may extend downward from an upper end of the tank mount 220. When the tank drawer 710 is closed, the tank mount 220 may contact a back surface of the tank drawer 710. A latch hole 222, through which a latch 721 that protrudes from the tank drawer 710 may be inserted or withdrawn, may be defined in or at a center of the step 221.

Top cover coupling portions 311 to be coupled to the top cover 100 may be disposed on or at an upper portion of a back surface of the front case 200. The top cover coupling portions 311 may be disposed above the front case 200 and the rear case 300. The top cover coupling portions 311 may be spaced at a predetermined distance so that the top cover coupling portions 311 may be hooked along a circumference of the top cover 100. The top cover coupling portions 311 may have a same structure and shape as corresponding coupling portions of the front and rear cases 200 and 300 except for a position thereof.

A plurality of deco coupling portions 312 may be disposed along both ends of the back surface of the front case 200. The plurality of deco coupling portions 312 may be coupled to the side deco 400 and vertically spaced a predetermined distance from each other along a side end or edge of the front case 200. The plurality of deco coupling portions 312 may restrict both first and second ends of the side deco 400 to couple the front case 200 to the side deco 400.

The plurality of deco coupling portions 312 may be disposed on both first and second sides of the front case 200. The plurality of deco coupling portions 312 may have a same structure and shape and different only in position. Thus, the plurality of deco coupling portions 312 may be disposed to have a same structure and shape on the front case 200 and the rear case 300. Thus, both the front case 200 and the rear case 300 may have structures coupled and fixed to the side deco 400.

The rear case 300 may define the rear outer appearance of the dehumidifier 1 and have a shape corresponding to a shape of the front case 200. The rear extension 310 may be disposed on each of both first and second ends or edges of an upper portion of the rear case 300 and coupled to the front extension 210.

An accessory hole 320 may be defined in or at an upper portion of the rear case 300. The accessory hole 320 may be a hole through which an accessory connection, which will be described hereinbelow, may later pass. That is, the accessory hole 320 may be opened in a shape corresponding to a shape through which accessory connection 570 may pass to protrude outside of the dehumidifier 1.

A suction grill 330 may be disposed below the accessory hole 320. The suction grill 330 may have a rectangular shape which may be recessed inward. The suction grill 330 may have a shape corresponding to a shape of a heat exchanger 30, which will be described hereinbelow later. The suction grill 330 may have a plurality of suction holes 331 so that external air is introduced into the dehumidifier 1.

A grill cover 340 may be mounted on a recessed outer portion of the suction grill 330. The grill cover 340 may cover a recessed space of the suction grill 330 and form a same line as an outer surface of the rear case 330. A plurality of holes may be defined in the grill cover 340 so that air may flow through the suction grill 330.

The grill cover 340 may be detachably disposed on the suction grill 330. A filter 341 may be mounted between the suction grill 330 and the grill cover 340. The filter 341 may filter foreign substances from the air introduced through the suction grill 330. The filter 341 may be fixed to the suction grill 330 or fixed to a back surface of the filter 341, as illustrated in FIG. 3.

A cord fixing hole 360 and a cord holder 350 may be disposed below the suction grill 330. The cord holder 350 may be provided as a pair of cord holder at each of both first and second sides. The cord holder 350 may protrude backward from the rear case 300 so that a power line to supply to power to the dehumidifier 1 may be wound around the pair of the cord holder 350 and stored. Protruding ends of the cord holder 350 may extend in an outward direction.

The cord fixing hole 360 may be disposed above the cord holder 350. The cord fixing hole 360 may be disposed at a central portion and may be a recessed space in the form of a socket so that a plug of an end of the power line may be inserted therein. Thus, the power line may be wound around the cord holder 350, and then, the plug may be inserted into the cord fixing hole 360 to effectively fix and store the power line.

The top cover coupling portions 311 and the deco coupling portions 312, which may have a same shape as those of the front case 200, may be disposed on an inner surface of the rear case 300. The top cover coupling portions 311 and the deco coupling portions 312 may have a same shape and function as those of the front case 200 and differ only in position.

Thus, the top cover 100 and the base pan 11 may be fixedly mounted on lower ends of the front case 200 and the rear case 300, respectively. Each side deco 400 may be mounted between the front case 200 and the rear case 300 to define the whole outer appearance of the dehumidifier 1.

A housing assembly 500, which may include a blowing fan 540 and the motor 530, and the heat exchanger 30 that heat-exchanges with suctioned air, may be disposed in or at an upper portion inside of the front case 200 and the rear case 300. Electronic components including a frame 600 that supports the housing assembly 500 and the heat exchanger 30, the water tank assembly 700 that collects condensed water generated in the heat exchanger 30, and the compressor 20 connected to the heat exchanger 30 to compress a refrigerant may be disposed in a lower portion inside of the front case 200 and the rear case 300.

The frame 600 may be mounted to or at a center of the base pan 11. The frame 600 may include a vertical portion 610 that extends substantially vertically, and a horizontal portion 620 substantially that extends horizontally from an upper end of the vertical portion 610. The vertical portion 610 may partition a lower space of the dehumidifier 1 into front and rear spaces to define the front space, in which the water tank assembly 700 may be mounted, and the rear space, in which the electronic components including the compressor 20 may be mounted. A main guide 630 and a sub guide 640 may be disposed on both first and second sides of the vertical portion 610 so that the tank drawer 710 may be slidably inserted or withdrawn.

The horizontal portions 620 may partition the inner space of the dehumidifier 1 into upper and lower spaces so that the housing assembly 500 and the heat exchanger 30 may be seated therein. A passage to guide the condensed water generated in the heat exchanger 30 to the water tank 800 may be defined in the horizontal portion 620.

A specific shape of the frame 600 will be described hereinbelow in more detail.

Figure 4:
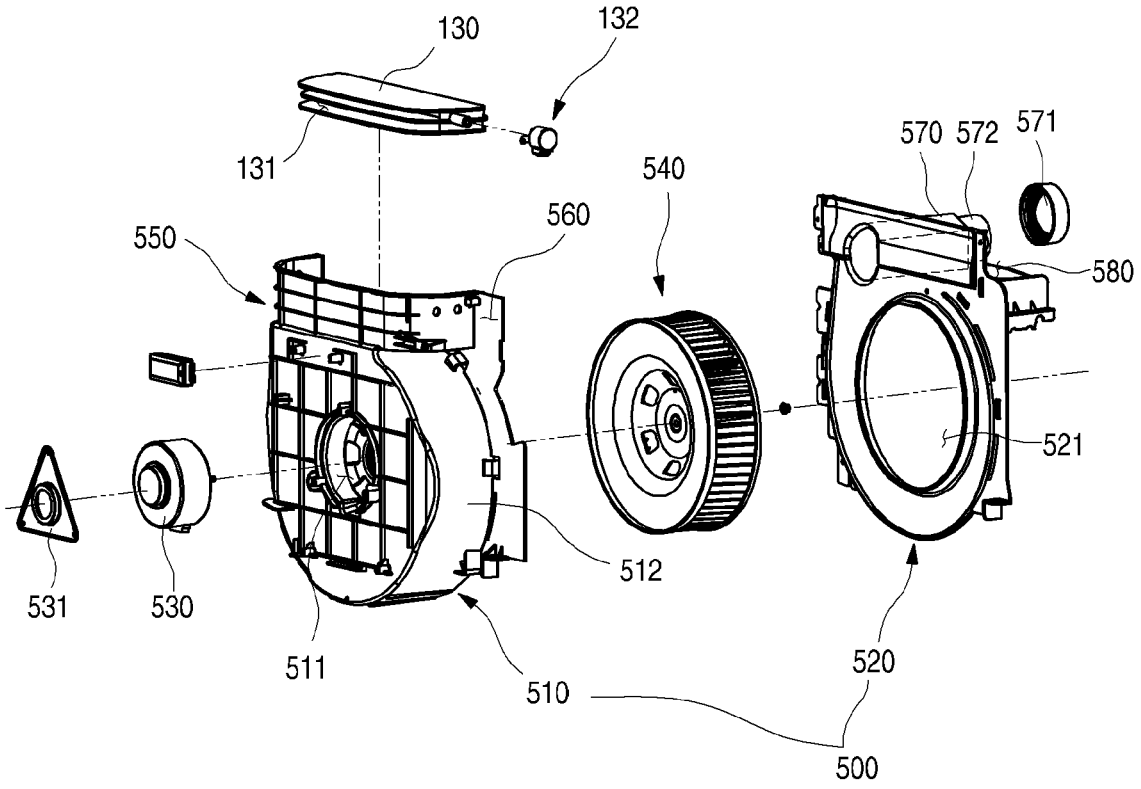
FIG. 4 is an exploded perspective view of a housing assembly of the dehumidifier of FIG. 1.

FIG. 4 is an exploded perspective view of a housing assembly of the dehumidifier of FIG. 1. The motor 530 and blowing fan 540 to forcibly blow air may be mounted on the housing assembly 500. The housing assembly 500 may be seated on an upper portion of the horizontal portion 620 of the frame 600. The housing assembly 500 may include a housing case 510, and a housing cover 520. The housing cover 520 and the housing case 510 may be coupled to each other to form a space in which the blowing fan 540 may be accommodated and a space through which air may flow.

The housing case 510 may have a shape, a rear surface of which may be opened to form the space in which the blowing fan 540 may be accommodated, and a top surface of which may be opened to allow the louver 130 to be mounted therein. The opened entire rear surface of the housing case 510 may be covered by the housing cover 520 having a shape corresponding thereto.

A motor accommodation portion 511 to accommodate the motor 530 may be recessed from a front surface of the housing case 510. A rotational shaft of the motor 530 may pass through the housing case 510 to extend in an inward direction. A BLDC motor having a relatively long life-cycle and easily controlled in rotational rate may be used as the motor 530 to rotate the blowing fan 540. The motor 530 may be fixedly mounted on the housing case 510 by a motor bracket 531.

The blowing fan 540, which may axially suction air and radially discharge the suctioned air, may be disposed in an inner space of the housing case 510. A sirocco fan that generates less noise and having superior blowing performance in comparison to other types of focus may be used as the blowing fan 540. Air introduced into the housing case 510 by the rotation of the blowing fan 540 may flow along an inner surface of the housing case 510, and then, may be discharged to the outside through the louver 130.

The inner surface of the housing case 510 may have a curved shape to improve flow of the air. A curved portion 512 having a predetermined curvature may be disposed on one side surface of both side surfaces of the housing case 510. The curved portion 512 may be formed or extend from a lower end of the housing case 510 to a louver mount 550, on which the louver 130 may be mounted. A capacitor mount 560, on which a capacitor 595 may be mounted, may be exposed between the curved portion 512 and the louver mount 550. That is, the curved portion 512 of the housing case 510 may be form a curvature of the inner surface of the housing case 510 adjacent to the capacitor mount 560.

The housing cover 520 may have a plate shape corresponding to a shape of the housing case 510. An orifice 521 that defines a passage through which the air may be suctioned may be defined to be opened in the housing cover 520. The accessory connection portion 570 may be disposed on a portion of an upper portion of the housing cover 520. The accessory connection portion 570 may have a shape to allow the inside of the housing case 510, on which the louver 130 may be mounted, to communicate with an external space. The accessory connection portion 570 may have an end with a shape corresponding so that the end may passes through the accessory hole 320 and be exposed to the outside.

A connection portion cap 571 may be detachably mounted on the end of the accessory connection portion 570. The connection portion cap 571 may cover the opened end of the accessory connection portion 570 to prevent air from leaking to the outside. A rotation coupling portion 572 may be disposed on an end of the accessory connection portion 570 to couple the accessory connection cap 571 to the accessory connection portion 570. The connection cap 571 may rotate to detach the rotation coupling portion 572 from the accessory connection portion 570. After the connection cap 571 is separated, an extension hose or other accessories may be simply coupled to the rotation coupling portion 572 through rotational manipulation thereof.

A control box mount 580 may be disposed above the orifice 521. The control box mount 580 may extend in a backward direction from a back surface of the housing cover 520 to vertically partition the space in which the heat exchanger 30 is disposed. A control box 590 to control an operation of the dehumidifier 1 may be mounted on the control box mount 580.

The control box mount 580 may be disposed at a position corresponding to a position of the capacitor mount 560. Thus, the capacitor 595 may be disposed at a same height as the control box 590 and may be connected to the control box 590 at a short distance.

The heat exchanger 30 may be disposed below the control box mount 580. The heat exchanger 30 may be seated on the horizontal portion 620 of the frame 600 and may have a size corresponding to a space defined between the control box mount 580 and the horizontal portion 620.

The heat exchanger 30 may include an evaporator connected to the compressor 20 and heat-exchanged with air introduced into the dehumidifier 1, and a condenser connected to the evaporator and in which a refrigerant flowing therethrough may be heat-exchanged with the air passing through the evaporator. The evaporator and the condenser may be installed in parallel and disposed in a front to rear direction. Thus, the air heat-exchanged with the refrigerant while passing through the evaporator may be heat-exchanged again with the refrigerant while passing through the condenser.

That is, the refrigerant supplied to the compressor 20 may flow toward the condenser through the evaporator via an expansion device, and then, may be introduced again into the compressor 20. Also, the air suctioned into the dehumidifier 1 may be introduced into the housing assembly 500 via the orifice 521 while successively passing through the evaporator and the condenser, and then, may be discharged again to the outside.

Thus, the indoor air suctioned in through the suction holes 331 may be heat-exchanged while passing through the evaporator to decrease a temperature thereof. Thus, moisture contained in the air may be liquefied and separated from the air, generating dehumidified air.

The air separated from the moisture while passing through the evaporator may be heated while passing through the condenser and then dried. The dried air may be discharged into the external space of the dehumidifier 1 through the discharge holes 131, in a state of dehumidified air from which moisture is removed.

As described above, as the evaporator and the condenser may be arranged in parallel, the air passing through the suction holes 331 may be dehumidified while passing through the evaporator and heated (dried) while passing through the condenser.

Also, the moisture separated from the air while passing through the evaporator may be changed into a liquid state. The phase-changed condensed water may flow along a drain passage 621 defined in the horizontal portion 620 of the frame 600, and then, may be collected into the water tank 800.

Also, a lower end of the condenser may be inserted into the horizontal portion 620, and the condensed water may flow via an area on which the condenser is mounted. When at least a portion of the lower end of the condenser is accommodated in the drain passage 621, the condenser may be cooled by the condensed water flowing along the drain passage 621 to improve efficiency of the condenser.

Figure 5:
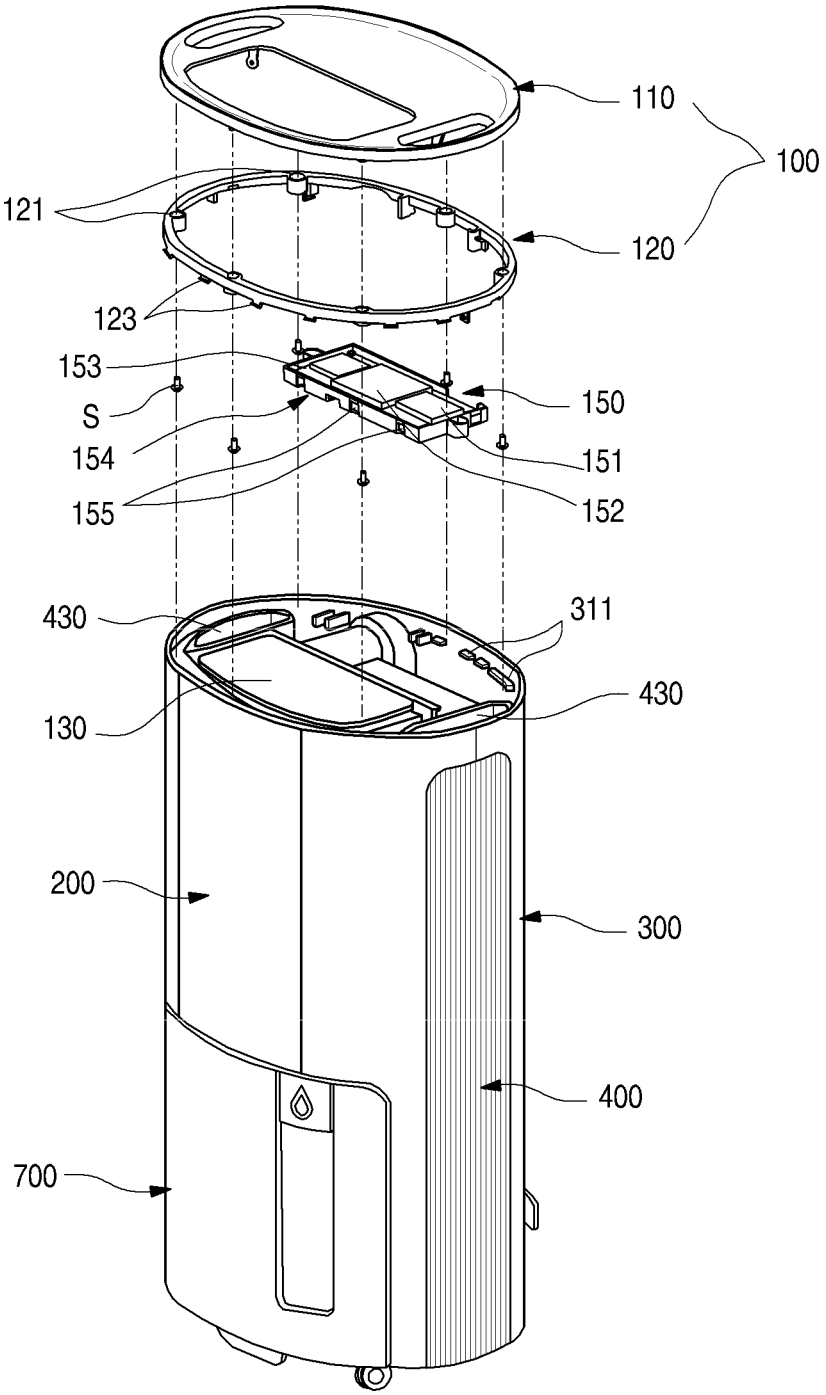
FIG. 5 is an exploded perspective view illustrating a coupling structure between a top cover and a main body of the dehumidifier of FIG. 1.
Figure 6:
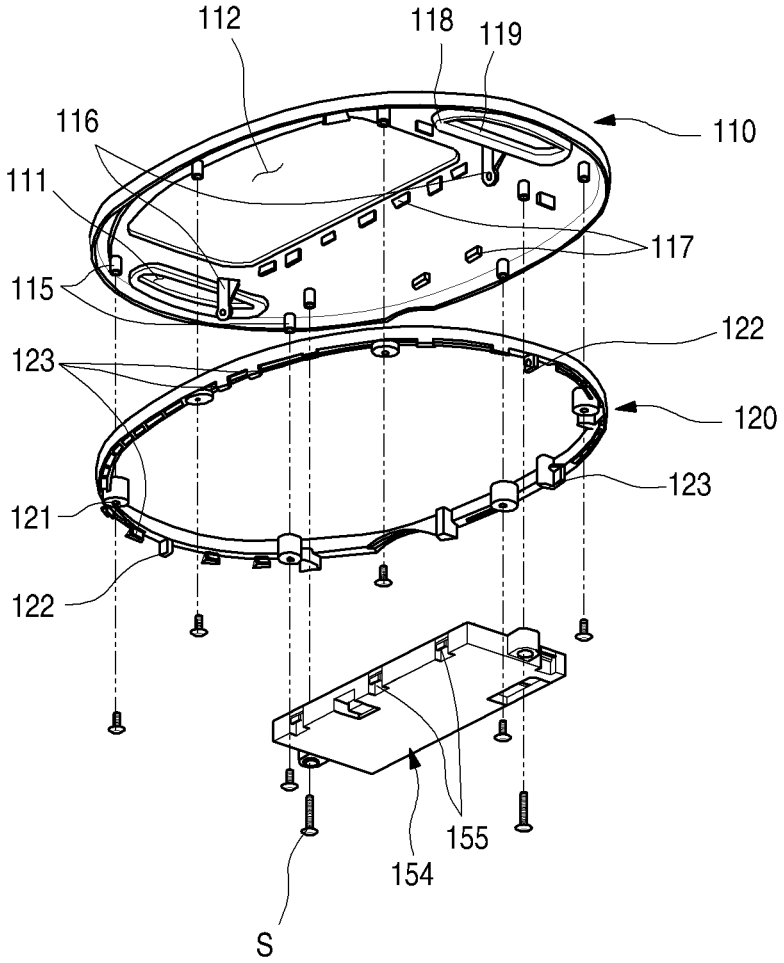
FIG. 6 is an exploded perspective view of the top cover of FIG. 5.

FIG. 5 is an exploded perspective view illustrating a coupling structure between a top cover and a main body of the dehumidifier of FIG. 1. FIG. 6 is an exploded perspective view of the top cover of FIG. 5.

The top cover 100 will be described in more detail with reference to referring to FIGS. 5 and 6. The top cover 100 may include a cover plate 110 and a cover frame 120.

The cover plate 110 may define the outer appearance of the top surface of the dehumidifier 1. The cover plate 110 may have a plate shape and an oval shape corresponding to a whole shape of the top surface of the dehumidifier 1.

One handle hole 111, in which a handle 40 of the dehumidifier 1 may be formed, may be punched in each of both first and second sides of the cover plate 110. Each handle hole 111 may be configured so that a hand of a user may be inserted therein to grasp a side of the dehumidifier 1. Each handle hole 111 may have a size corresponding to a size of an opening 430 of the side deco 400.

A louver mounting hole 112, in which the louver 130 may be disposed, may be defined in the cover plate 110. The louver mounting hole 112 may have a size and shape corresponding to a size and shape of the louver 130 in a state in which the louver 130 is closed. Thus, a top surface of the louver 130 may cover the louver mounting hole 112 in the state in which the louver 130 is closed, to form a same plane as the cover plate 110. When the louver 130 is opened, the louver mounting hole 112 may also be opened.

A display window 113 may be disposed at a rear side of the louver mounting hole 112. The display window 113 may allow a display 152 to be exposed. The display window 113 may be opened in a shape corresponding to the display 152 or may be formed of a transparent material to cover the opened portion. Also, a print 114 to inform a position of the manipulator 151 may be further disposed on the cover plate 110 adjacent to the display window 113. Thus, the print 114 may be touched to manipulate the manipulator 151.

Cover coupling portions 115 may be disposed to be spaced a predetermined distance from each other along a circumference of a bottom surface of the cover plate 110. Each cover coupling portion 115 may be a portion to which a screw S passing through the cover frame 120 may be coupled. That is, the cover plate 110 may be coupled to the cover frame 120 by the cover coupling portion 115.

A cover fixing portion 116 to be coupled to the housing assembly 500 using the screw S may extend downward from each of both sides of a bottom surface of the cover plate 110.

Each cover fixing portion 116 may contact one side of the control box mount 580 of the housing cover 520 and be fixed by the screw S to allow the top cover 100 to be fixedly mounted.

A manipulator fixing member 117 to fixedly mount a manipulator assembly 150 may be disposed on the bottom surface of the cover plate 110 corresponding to the manipulator 151 and the display 152. The manipulator fixing member 117 may have a rib shape. A plurality of the manipulator fixing member 117 may be provided, and the plurality of manipulator fixing members 117 may be disposed at a predetermined distance along a circumference of the manipulator assembly 150. A hook may be disposed on an end of the manipulator fixing member 117 to restrain a circumference of the manipulator assembly 150 by the manipulator fixing member 117 so that the manipulator assembly 150 may be fixedly mounted on the bottom surface of the cover plate 110.

The manipulator assembly 150 may include the display 152 and the manipulator 151. A display and a plurality of switches or sensors may be disposed on one PCB 153 to form the display 152 and the manipulator 151 so that a user may manipulate an operation of the dehumidifier 1 or inform an operation state of the dehumidifier 1 to the outside. Alternatively, the manipulator assembly 150 may be include only the manipulator 151, and the display 152 may be independently provided as a separate component.

The manipulator assembly 150 may further include a board case 154 that accommodates the PCB 153. At least one case hook 155, in which the manipulator fixing member 117 may be inserted to pass therethrough and be hooked thereto, may be further disposed on a circumference of the board case 154.

A handle hole rib 118 that extends in a downward direction may be disposed along a circumference of each handle hole 111. The handle hole rib 118 may have a shape corresponding to an upper end of the side deco 400 so that the handle hole rib 118 and the upper end of the side deco 400 may be coupled to each other to correspond to each other. In detail, a rib step 119 having a step may be disposed on the handle hole rib 118 and be coupled to a deco step 431 disposed on the upper end of the side deco 400 to correspond to the deco step 431. Thus, the side deco 400 may be fixed while being maintained in position on the cover plate 110 to form the handle 40.

A circumference 160 may be disposed around a top surface of the cover plate 110. The circumference 160 may have an upward protruding shape. An inside of the circumference 160 may have a roundly recessed shape. A chrome line may be printed on the circumference 160 of the cover plate 110 as if a separate member formed of a chrome material is coupled to the cover plate 110. For this, the cover plate 110 may be, for example, injection-molded using an in-mold labeling (IML) manner. That is, the cover plate 110 may be injection-molded using a plastic material. A chrome film may be printed on the circumference 160.

As the cover plate 110 may be molded through the above-described manner it may be unnecessary to having a coupling structure of a separate component formed of a chrome material. When the cover plate 110 is molded, the cover plate 110 together with the circumference 160 may be molded at a same time.

To mold the cover plate 110 using the IML injection manner, the cover plate 110 may have to be simplified in structure. For this, it is necessary to provide a cover frame 120 having a separate coupling structure to couple the top cover 100 to the front and rear cases 200 and 300.

That is, the top cover 100 may be coupled to the front and rear cases 200 and 300 due to the coupling structure between the cover frame 120 and the cover plate 110. Also, the cover plate 110 may have a simplified structure due to the cover frame 120 being coupled to the front and rear cases 200 and 300, and thus, the cover plate 110 may be injection-molded using the ILM manner.

The cover frame 120 may be mounted on the bottom surface of the cover plate 110 and have a ring shape with a size corresponding to a size of the cover plate 110. Frame coupling portions 121 disposed on the bottom surface of the cover plate 110 and spaced a predetermined distance from each other along a circumference of the cover plate 110 may be disposed on the cover frame 120.

A screw S for coupling, which may be disposed at a position corresponding to each of the cover coupling portions 115, may be coupled to the cover plate 110. Each cover coupling portions 115 may extend in a downward direction. The extending cover coupling portion 115 may be inserted into the frame coupling portion 121.

In this state, when the screw S is coupled in an upward direction from a lower side, the screw S may pass through the frame coupling portion 121 and then be coupled to the cover coupling portion 115. Thus, the cover frame 120 may be fixed to the cover plate 110.

The deco fixing portion 122 that extends in the downward direction and through which the screw S coupled to the housing assembly 500 may pass, may be disposed on each of both first and second sides of the cover frame 120. The deco fixing portion 122 may be screw-coupled to a handle coupling portion 424 of the side deco 400, which will be described hereinbelow, to maintain a fixed state of the top cover 100 and the side deco 400.

A plurality of frame fixing hooks 123 may be disposed along a circumference of the bottom surface of the cover frame 120. The top cover 100 may be hooked with top cover coupling portions 211 disposed on the front case 200 through the frame fixing hooks 123.

Thus, the cover frame 120 may be coupled to the front case 200 and the rear case 300. As the cover frame 120 may be coupled to the cover plate 110, the top cover 100, the front case 200, and the rear case 300 may have structures through which the top cover 100 and the front case 200 may be coupled and fixed to each other.

Figure 7:
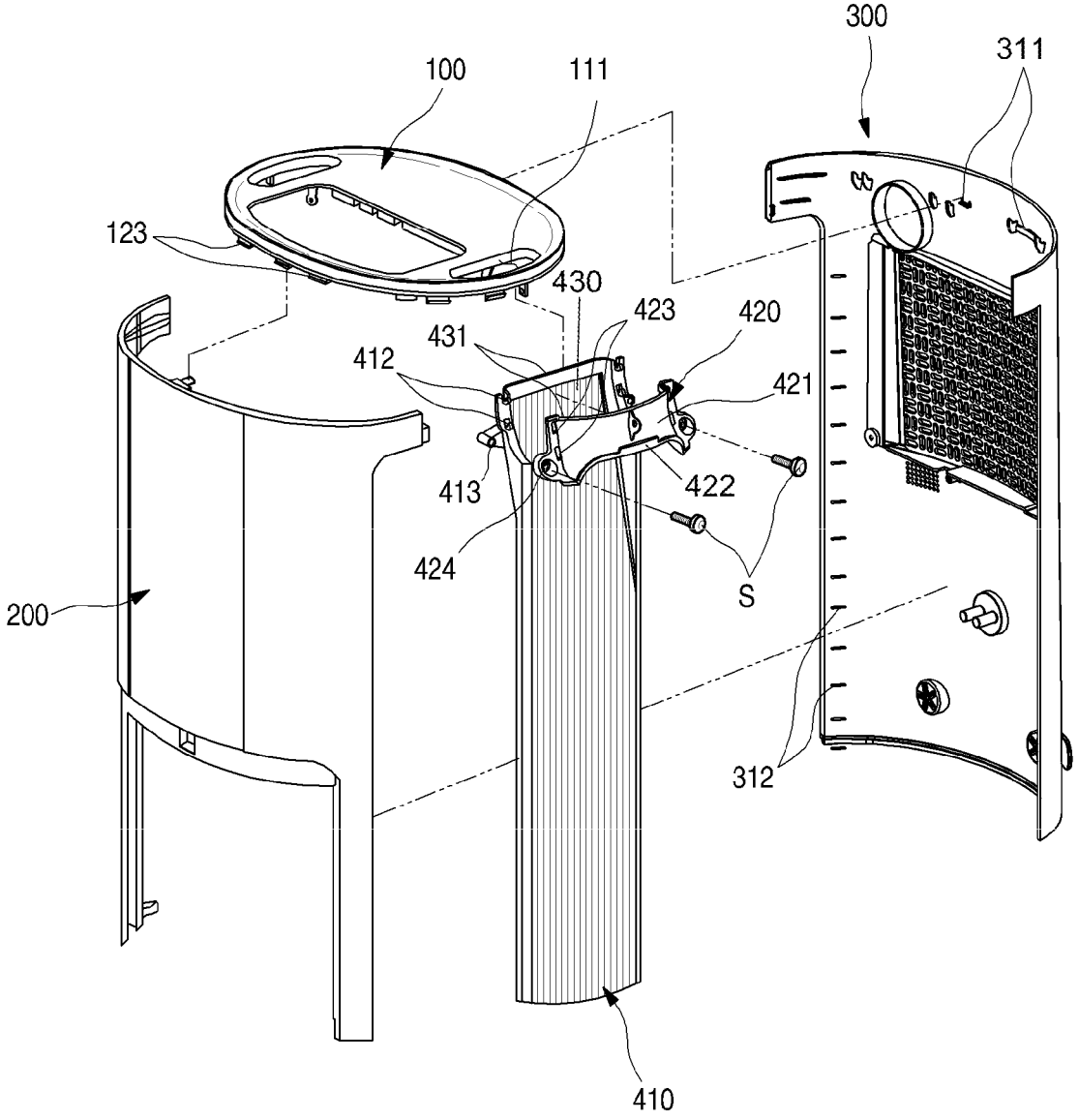
FIG. 7 is an exploded perspective view illustrating a coupling structure of a side deco of the dehumidifier of FIG. 1.

FIG. 7 is an exploded perspective view illustrating a coupling structure of a side deco of the dehumidifier of FIG. 1. Referring to FIG. 7, each side deco 400 may define a portion of a side surface of the dehumidifier 1. Each side deco 400 may be disposed between the top cover 100 and the base pan 11, so that upper and lower ends of the side deco 400 may be respectively fixed to the top cover 100 and the base pan 11. Also, the side deco 400 may be disposed between the front case 200 and the rear case 300, so that a front end of the side deco 400 may be coupled to the front case 200, and a rear end of the side deco 400 may be coupled to the rear case 300.

Each side deco 400 may have a vertically long plate shape and include a deco member 410, and a handle member 420. The deco member 410 may define a side shape of the dehumidifier 1. The deco member 410 may have an upper end that contacts a bottom surface of the cover plate 110 and a lower end that contacts the base pan 11.

The handle member 420 may be coupled to an upper portion of the deco member 410. An upper end of the handle member 420 may be coupled to the cover plate 110 and disposed on an inner side surface of the front extension 210 and the rear extension 310 to form the handle 40.

The deco member 410 may have a rectangular plate shape. When the side deco 400 is mounted, both first and second ends of the deco member 410 may be inserted into and restricted by the front case 200 and the rear case 300. Thus, when the front case 200 and the rear case 300 are coupled to each other, both ends of the deco member 410 may be restricted between the front case 200 and the rear case 300 and then maintained in the restricted state. Also, a lower end of the deco member 410 may be inserted into and fixed to the base pan 11, and an upper end of the deco member 410 may be fixed to the cover plate 110.

An upper portion of the deco member 410 may be rounded inward, and the handle member 420 may be disposed on the upper end of the deco member 410. Both side ends of the deco member 410 and the handle member 420 may be coupled to each other to define the opening 430 in a space therebetween. Also, both side ends of the deco member 410 and the handle member 420 may be spaced apart from each other by a distance corresponding to the handle hole 111 to form a portion of the handle 40.

To couple the deco member 410 to the handle member 420, a handle coupling protrusion 412 that protrudes in a direction of the handle member 420 may be disposed on each of both sides of the deco member 410. An end of the handle coupling protrusion 412 may be bent and hooked with the handle member 420.

A deco fixing portion 413 that extends in a lateral direction may be disposed on each of both sides of the deco member 410. The deco fixing portion 413 may be coupled to a handle coupling portion 424. The deco fixing portion 413 and the handle coupling portion 424 may be fixed by the screw S, which may be coupled to pass through the handle coupling portion 424 and the deco fixing portion 413.

Both first and second ends of the handle member 420 may be coupled to the deco member 410. Also, each of first and second ends of the handle member 420 may be rounded to have a curvature corresponding to a curvature of the handle hole 111. Thus, both of the first and second ends of the handle member 420 may form a space therebetween, into which a user's hand may be inserted when the handle member 420 is coupled to the deco member 410.

Also, a round portion 421 having a curvature in a vertical direction may be disposed on the handle member 420. The round portion 421 may protrude in an outward direction toward a lower side thereof, so that a user's hand may be inserted to grasp an inner surface of the handle member 420. A handle support 422 that extends in an upward direction to contact inner surfaces of the front extension 210 and rear extension 310 may be further disposed on a lower end of the handle member 420. Thus, even though a user grasps the handle 140, the handle 40 may be stably maintained without being damaged.

A handle coupling hole 423, into which a handle coupling protrusion 412 may be inserted, may be defined in both of the first and second ends of the handle member 420. The handle coupling hole 423 may extend lengthwise in a vertical direction so that the handle coupling protrusion 412 may move downward after being inserted into the handle coupling hole 423 to restrict the handle member 420 by the handle coupling protrusion 412.

The handle coupling portion 424 that extends bilaterally may be disposed on both of the first and second ends of the handle member 420. The handle coupling portion 424 may be disposed at a position corresponding to the deco coupling portion 413, and the screw S may pass through the handle coupling portion 424.

The handle member 420 may have a vertical width corresponding to the front extension 210 and the rear extension 310. Also, the lower end of the handle member 420 may have a round portion with a curvature corresponding to a curvature of a lower end of each of the front extension 210 and the rear extension 310. Thus, when the front case 200 and the rear case 300 are coupled to each other, the handle 40 may be stably formed without being exposed to the outside.

The handle member 420 and the deco member 410 may be coupled to each other to allow the upper end of the side deco 400 to form the opening 430. The opening 430 may have a shape corresponding to a shape of the handle hole 111. The open circumference of the handle hole 111 may extend to be rounded in a downward direction. The rib step 119 may be disposed on a lower end of the handle hole 111. The deco step 431 may be disposed on the upper end of each of the deco member 410 and the handle member 420, which may correspond to the rib step 119, and may be disposed so that the deco step 431 and the rib step 119 match each other.

Thus, the coupling structure between the front case 200 and the rear case 300 and between the side deco 400 and the cover plate 110 may provide a stable handle structure, as well as fix the side deco 400 thereto.

Figure 8:
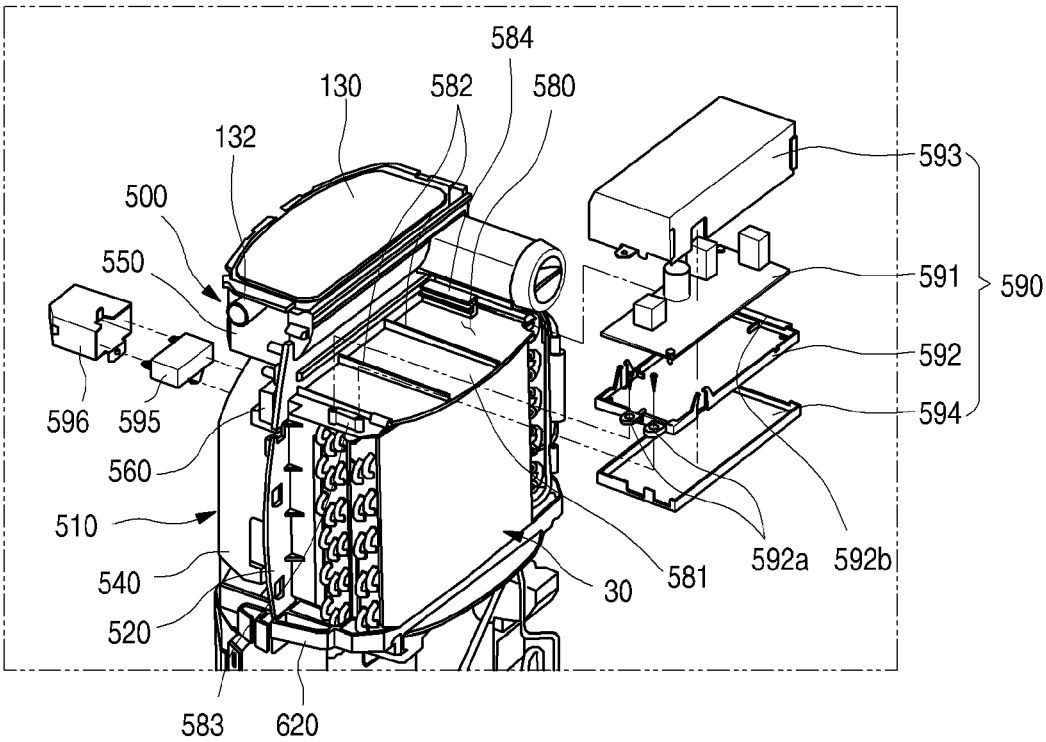
FIG. 8 is an exploded perspective view illustrating a coupling structure of a PCB assembly of the dehumidifier of FIG. 1.

FIG. 8 is an exploded perspective view illustrating a coupling structure of a PCB assembly of the dehumidifier of FIG. 1. Referring to FIG. 8, when the control box mount 580 is disposed on the housing assembly 500, the control box 590 may be mounted on the control box mount 580. The control box mount 580 may be disposed at a rear side of the louver 130 mounted on the housing assembly 500 to form a seating surface 581 that extends in a backward direction.

A pair of ribs 582 that protrudes in an upward direction may be disposed on the seating surface 581. Each of the pair of ribs 582 may extend lengthwise in a front to rear direction to support a lower portion of the control box 590.

A box fixing portion 583 may protrude from one side of the seating surface 581. The box fixing portion 583 may be disposed at a position corresponding to a box coupling portion **592*a* that extends laterally from one side of the control box 590. The screw S may pass through the box coupling portion 592*a*, and then, may be coupled to fix the control box 590**.

A box guide 584 may be disposed on one side facing the box fixing portion 583. The box guide 584 may extend lengthwise in a front to rear direction so that a guide piece **592*b* of the control box 590** may be slidably inserted.

That is, when the control box 590 is mounted, the guide piece **592*b* of the control box 590 may move in a backward direction and be inserted into the box guide 584. When the control box 590 completely moves, the box coupling portion 592*a* may be disposed at a position that overlaps the box fixing portion 583. In this state, the screw S may be coupled from an upper side to fixedly mount the control box 590 on the control box mount 580. On the other hand, if service for the control box 590 is required, coupling of the screw S may be released, and then the control box 590 may be slid backward to easily separate the control box 590**.

The control box 590 may include a PCB 591, on which various devices for controlling operation of the dehumidifier 1 may be mounted, a board base 592 formed of a plastic material to accommodate the PCB 591, and a board case that surrounds upper and lower portions of the board base 592.

The board base 592 may define a space, in which the PCB 591 may be accommodated. The box coupling portion **592*a* and the guide piece 592*b* may protrude in an outward direction from both ends of the board base 592**, respectively.

The board case may include an upper case 593 and a lower case 594. The board base 592, in which the PCB 591 may be accommodated, may be mounted in a space between the upper case 593 and the lower case 594. The board case may be formed of a metal material, such as stainless steel, for example. Even though a fire may occur in the PCB 591, combustion may occur only within the board case, preventing the fire from being spread to other components of the dehumidifier 1.

The capacitor mount 560 may be disposed at a front side of the control box mount 580. The capacitor mount 560 may be disposed adjacent to the control box mount 580. The capacitor 595 may be accommodated into a capacitor cover 596 having an accommodation space therein. The capacitor cover 596 may be coupled to the capacitor mount 560.

Thus, the capacitor 595 may be fixed to the capacitor mount 560. The capacitor cover 596, which may be formed of a metal material, such as stainless steel, may completely surround the capacitor 595 to protect the capacitor 595 against fire.

The capacitor 595 may have a relatively high height. Thus, if the capacitor 595 increases in capacitance, the capacitor may further increase in size. Thus, as the capacitor 595 and the capacitor cover 596 are separated from the control box 590, a mounting space of the control box 590 may be more utilized, and also, the inner space of the dehumidifier 1 may be efficiently used.

Figure 9:
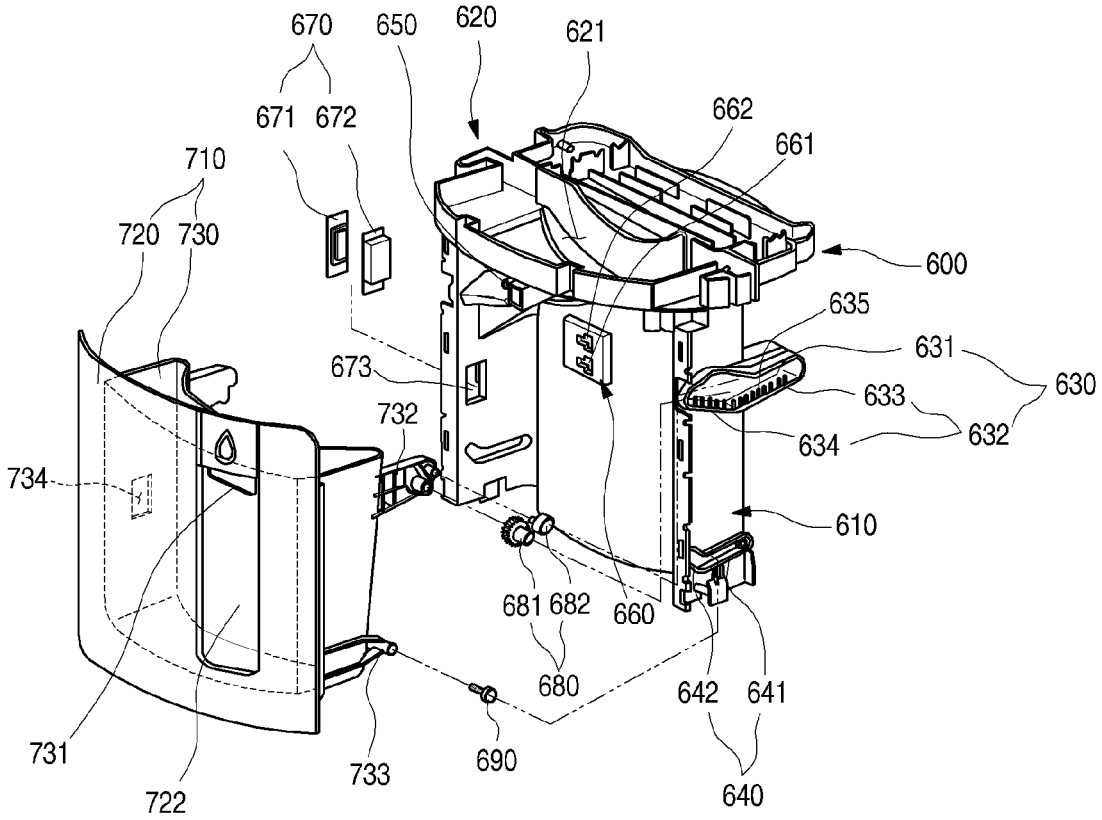
FIG. 9 is an exploded perspective illustrating a coupling structure of a water tank assembly of the dehumidifier of FIG. 1.
Figure 10:
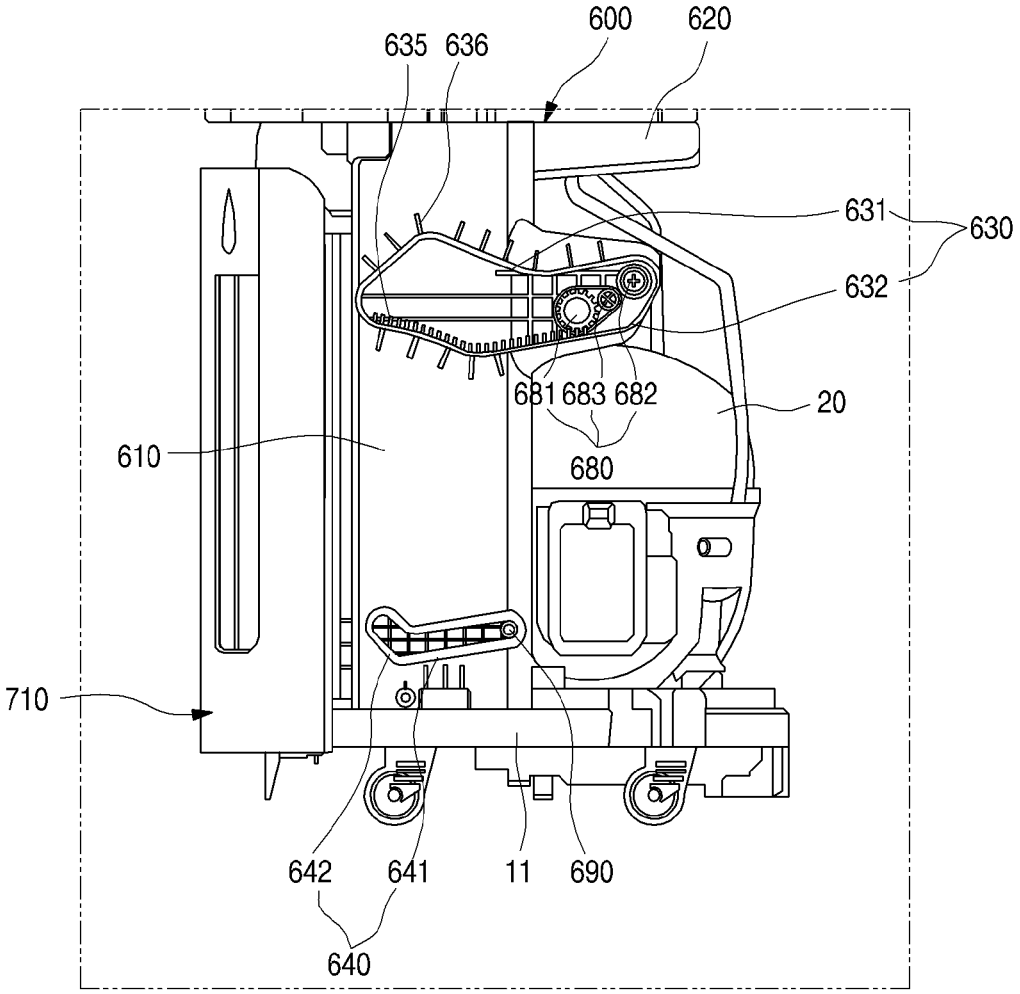
FIG. 10 is a side view illustrating a structure of a guide assembly that guides insertion and withdrawal of the water tank assembly of FIG. 9.

FIG. 9 is an exploded perspective view illustrating a coupling structure of a water tank assembly of the dehumidifier of FIG. 1. FIG. 10 is a side view illustrating a structure of a guide assembly that guides insertion and withdrawal of the water tank assembly of FIG. 9.

Referring to FIGS. 9 and 10, the water tank assembly 700 may be disposed at a front side of the vertical portion 610 of the frame 600. A space, in which a tank drawer 710 forming the water tank assembly 700 may be accommodated, may be defined in the front side of the vertical portion 610. When the water tank 800 is completely inserted, the tank drawer 710 may disposed on a same plane as a front surface of the cover plate 110.

A latch 650, into which the locker 721 may be inserted to selectively restrict the locker 721, may be disposed on or at a central portion of the front surface of the frame 600, particularly, a front end of the horizontal portion 620. The latch 650 may be disposed at a position corresponding to the latch hole 222. When the tank drawer 710 is closed, the latch 650 may be hooked with the locker 721 (see FIG. 21) to maintain a closed state of the tank drawer 710.

When the latch 650 is inserted once, the latch 650 may be hooked with the locker 721. When the locker 721 moves again in a forward direction by an external force, hooking between the latch 650 and the locker 721 may be released to allow the tank drawer 710 to be withdrawn. That is, a locking structure between the latch 650 and the locker 721 may be similar to a general pushing type latching structure.

The locking device including the latch 650 and the locker 721 may have a locking structure different from structures of the latch 650 and the locker 721 disclosed above. Also, various structures to maintain the closed state of the tank drawer 710 may be selectively applied.

A full level detector 660 may be disposed on the front surface of the vertical portion 610 facing toward the tank drawer 710. A pair of sensors may be vertically disposed on the full level detector 660 to determine a full level of water by detecting a position of a floater 830 of the water tank 800. When a position of the floater 830 is detected by the pair of sensors that detects the full level of the water tank 800, a lower water level sensor 661 of the pair of sensors may transmit a full level signal to the display 152 to inform a user that a water level in the water tank 800 has reached the full level. When a position of the floater 830 is detected by an upper safety sensor 662 of the pair of sensors, operation of the dehumidifier 1 may be stopped to prevent condensed water from being further collected into the water tank 800. Also, the full level may be informed to the outside to allow the user to empty the water tank 800.

A lighting module 670 may be mounted on or at one side of the vertical portion 610 corresponding to a lateral side of the tank drawer 710. The lighting module 670 may irradiate light into the water tank 800 to visualize the water level in the water tank 800 and function as indirect lighting. Thus, the light may be irradiated from one side toward the inside of the water tank 800.

The lighting module 670 may include a light emitter 671 to emit light, and a scattering member 672 disposed at a front side of the light emitter 671 to scatter the light emitted from the light emitter 671. A device capable of emitting light, such as a LED, may be used as the light emitter 671. Alternatively, different materials capable of emitting light may be used. The light emitter 671 may emit a plurality of colors. That is, the light emitted from the light emitter 671 may change in color according to a state of the dehumidifier 1.

For example, the color of the light emitted from the light emitter 671 may change according to the water level detected by the full level detector 660. That is, in a case of a normal water level, lighting having a blue color may be emitted. In a case of a full level, light having a yellow color may be emitted. In a case of a dangerous level, light having a red color may be emitted. Thus, a user may recognize the water level by the color seen through an identification window 722 to empty the water tank.

Also, regarding a humidity of the air suctioned into the dehumidifier 1, in a case of normal humidity, a blue color may be emitted. In a case of normal humidity or more, a yellow color may be emitted. In a case of high humidity for which dehumidification is required, a red color may be emitted. For this, a humidity sensor 370 to detect external humidity may be further disposed on or at one side of the dehumidifier 1. The humidity sensor 370, the lighting module 670, and the full level detector 660 may be connected to the control box 590 to realize visualization using the water tank 800 according to the state of the dehumidifier 1.

Also, the scattering member 672 may be formed of a transparent or translucent material, so that the light emitted from the light emitter 671 may pass through the scattering member 672. The scattering member 672 may cover the light emitter 671 to protect the light emitter 671.

The light emitted from the light emitter 671 may be reflected or refracted by the scattering member 672, so that the light may be uniformly smoothly emitted into the water tank 800. Thus, the light emitted from the light emitter 671 may light the whole water tank 800.

Accordingly, the lighting module 670 may operate to light the whole inside of the water tank 800. Further, the light may be emitted to the outside through the identification window 722 to function as indirect lighting. Furthermore, the operation state of the dehumidifier 1 may be identified at a long distance through the color identified through the identification window 722. For this, although not shown, an open lighting hole 673 may be defined in a side surface of the tank drawer 710 or a position corresponding to the lighting module 670 to emit light into the water tank 800 in a state in which the water tank 800 is accommodated in the tank drawer 710.

The main guide 630 and the sub guide 640 may be disposed on both first and second sides of the vertical portion 610, respectively. The main guide 630 and the sub guide 640 may guide slidable insertion and withdrawal and tilting of the tank drawer 710. The sub guide 640 may be disposed below the main guide 630.

The main guide 630 may be disposed on an upper portion of the vertical portion 610 to define a passage through which a roller 680, which will be described hereinbelow, may move. The main guide 630 may include a lower portion 632 that defines a lower portion thereof, and an upper portion 631 that defines an upper portion thereof. The upper portion 631 and the lower portion 632 may have tilts or curvatures corresponding to each other. Both ends of the upper portion 631 and the lower portion 632 may be connected to each other to form a close loop shape on the whole. The lower portion 632 may include a downward tilted portion 633 having a tilt which is gradually tilted in a downward direction toward a front side from a rear side, and an upward tilted portion 634 having a tilt which is gradually tilted in an upward direction toward a front side from an end thereof.

When the tank drawer 710 is closed, the roller 680 may be disposed at a rearmost position of the main guide 630 and a highest position of the downward tilted portion 633. Further, when the tank drawer 710 is opened and tilted, the roller 680 may move along the main guide 630. Furthermore, when the tank drawer 710 is completely withdrawn and tilted, the roller 680 may be disposed at a foremost position of the main guide 630 and a highest position of the upward tilted portion 634.

A gear 635 may be disposed inward form each of the downward tilted portion 633 and the upper tilted portion 634. The gear 635 may have a rack structure. The gear 635 may have a teeth shape so that a roller 681 disposed on the roller 680 may move along the gear 635.

The upper portion 631 may contact a main roller 682 of the roller 680. When the tank drawer 710 moves, the main roller 682 may move along the upper portion 631 in a state in which the main roller 682 contacts an inner surface of the upper portion 631.

A plurality of reinforcing ribs 636 that vertically extends from edges of the main guide 630 and the vertical portion 610 may be disposed around an outer circumference of the main guide 630. The plurality of reinforcing ribs 636 may be disposed spaced a predetermined distance from each other to prevent the main guide 630 from being deformed by a load applied to the main guide 630.

The sub guide 640 may be disposed below the main guide 630 to accommodate a sub roller 690, which will be described hereinbelow. The sub guide 640 may have a diameter corresponding to a diameter of the sub roller 690. The sub guide 640 may include a withdrawal portion 641 to guide withdrawal of the tank drawer 710, and a tilting portion 642 to guide tilting of the tank drawer 710 at an end of the withdrawal portion 641. The withdrawal portion 641 may have a downward tilt, and the tilting portion 642 may have an upward tilt.

The water tank assembly 700 may collect condensed water generated in the heat exchanger 30. The water tank assembly 700 may be disposed in a space defined in or at a front side of the frame 600. The water tank assembly 700 may be connected to the frame 600 and slid to be inserted or withdrawn in a front to rear direction. When the water tank assembly 700 is completely withdrawn, the water tank assembly 700 may rotate using a lower portion thereof as a shaft, and then, may be tilted to open a top surface thereof.

The water tank assembly 700 may include the water tank 800 to store the condensed water, and the tank drawer 710, in which the water tank 800 may be accommodated and inserted and withdrawn so that the water tank 800 may be easily mounted or separated therefrom. The tank drawer 710 may define an outer appearance of a front surface of the water tank assembly 700. The water drawer 710 may include a front surface 720 that defines a portion of the front surface of the dehumidifier 1, that is, a portion of the front case 200, and an accommodation portion 730 opened upward from a rear side of the front surface to accommodate the water tank 800 in a downward direction from an upper side thereof.

The accommodation portion 730 may have a shape corresponding to a shape of the water tank 800. The accommodation portion 730 may be opened in an upward direction so that water may be easily supplied, and the water tank 800 may be easily inserted or withdrawn in a state in which the water tank 800 is mounted.

The locker 721, which may extend in a backward direction, may be disposed on a central portion of an upper end of the front surface 720. The locker 721 may extend in a backward direction and be coupled and fixed to the latch 650 in a state in which the water tank assembly 700 is completely inserted.

The identification window 722 to identify a water level of the water tank 800 mounted on the accommodation portion 730 through a naked eye may be further disposed on one side of the front surface 720. The identification window 722 may extend lengthwise in a vertical direction. The identification window 722 may be disposed so that at least a portion of the water tank 800 is exposed. Thus, a water level of the water tank 800 may be identified from the outside through the identification window 722.

The identification window 722 may be positioned at one side of first and second sides of the front surface 720. The identification window 722 may be disposed at one side which may be opposite to the lighting module 670. Thus, when light is emitted from the lighting module 670, locally strong light may not be irradiated through the identification window 722, but rather, may be smoothly uniformly irradiated through identification window 722 in a state, in which the light is scattered by the water within the water tank 800.

The identification window 722 may be formed by simply opening the front surface 720. As necessary, the identification window 722 may be covered by a transparent material so that the inside of the water tank 800 may be seen from the outside. Also, for using the light within the water tank 800 as indirect lighting, a specific color or pattern may be disposed on the transparent material of the identification window 722. Thus, when the light is irradiated into the water tank 800 by the lighting module 670, the light irradiated into the water tank 800 may leak to the outside through the identification window 722 so that the inside of the water tank 800 may be identified, and also, the light used as indirect lighting, such as a mood lamp.

For this, a transmission portion 734 may be disposed on or at a side surface of the accommodation portion 730. The transmission portion 734 may be opened at a position corresponding to the lighting hole 673 and the lighting module 670, in a state in which the tank drawer 710 is closed. Thus, when the lighting module 670 operates, the light emitted from the lighting module 670 may be irradiated into the water tank 800 from one side of the water tank 800 via the lighting hole 673 and the transmission portion 734 to light the inside of the water tank 800.

A detection hole 731 to detect a water level may be opened in or at a rear surface of the accommodation portion 730. The detection hole 731 may be opened in a shape corresponding to a shape of the full level detector 660. Thus, the full level or dangerous level within the water tank 800 may be easily detected through the detection hole 731.

An upper extension 732 and a lower extension 733, which may extend in a backward direction, may be provided in a pair on both sides of the accommodation portion 730. The upper extension 732 may extend in a backward direction from the accommodation portion 730, and the lower extension 733 may extend in the backward direction from a lowest portion of the accommodation portion 730.

The upper extension 732 may extend further in the backward direction that the lower extension 733. The roller 680 may be mounted on an end of the upper extension 732, and the sub roller 690 may be mounted on a rear end of the lower extension 733, so that the tank drawer 710 may be inserted and withdrawn and tilted.

The roller 680 may be disposed on a rear end of the upper extension 732 and engaged with the gear 635 of the main guide 630. The roller 680 may include the roller gear 681 that moves along the gear 635, a damper 683 to buffer a rotation rate and impact of the roller gear 681, and the main roller 682 that contacts the upper portion 631 of the main guide 630.

The roller gear 681 and the main roller 682 may, respectively, contact the lower portion 632 and the upper portion 631 to allow the tank drawer 710 to be inserted and withdrawn or tilted. The roller gear 681 may move along the gear 635 of the lower portion 632, and the main roller 682 may contact an inner circumferential surface of the upper portion 631 to support the upper portion 631.

Thus, the water tank assembly 700, which may be slidably inserted and withdrawn and tilted, may not be vertically shaken, as well as, the tank drawer 710 may not lean due to the coupling between the gear 635 and the roller gear 681. Thus, the water tank assembly 700 may be stably inserted or withdrawn.

The damper 683 may be disposed on or at one side of the roller gear 681. When the roller gear 681 rotates, the damper 683 may reduce a rotation rate of the roller gear 681 so that the tank drawer 710 may stably rotate. An operation structure of the tank drawer 710 will be described hereinbelow in more detail.

Figure 11:
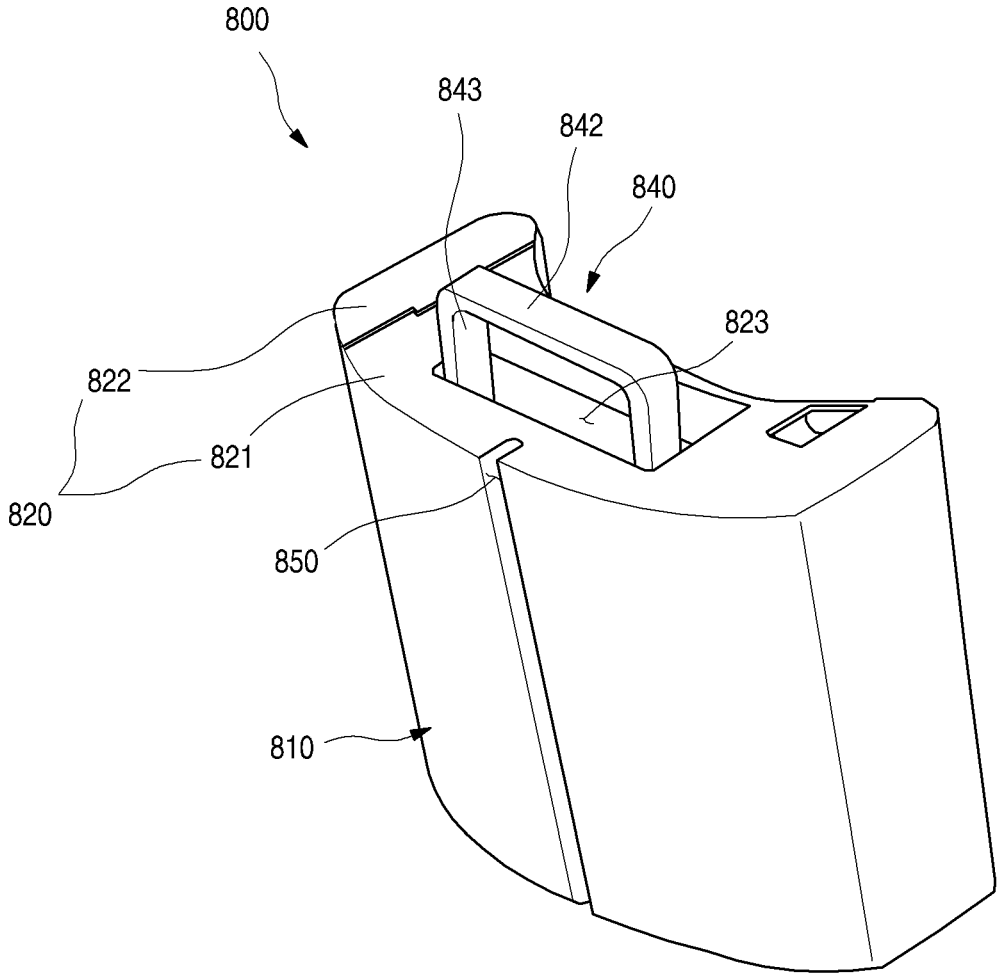
FIG. 11 is a perspective view of a water tank of the water tank assembly of FIG. 9.
Figure 12:
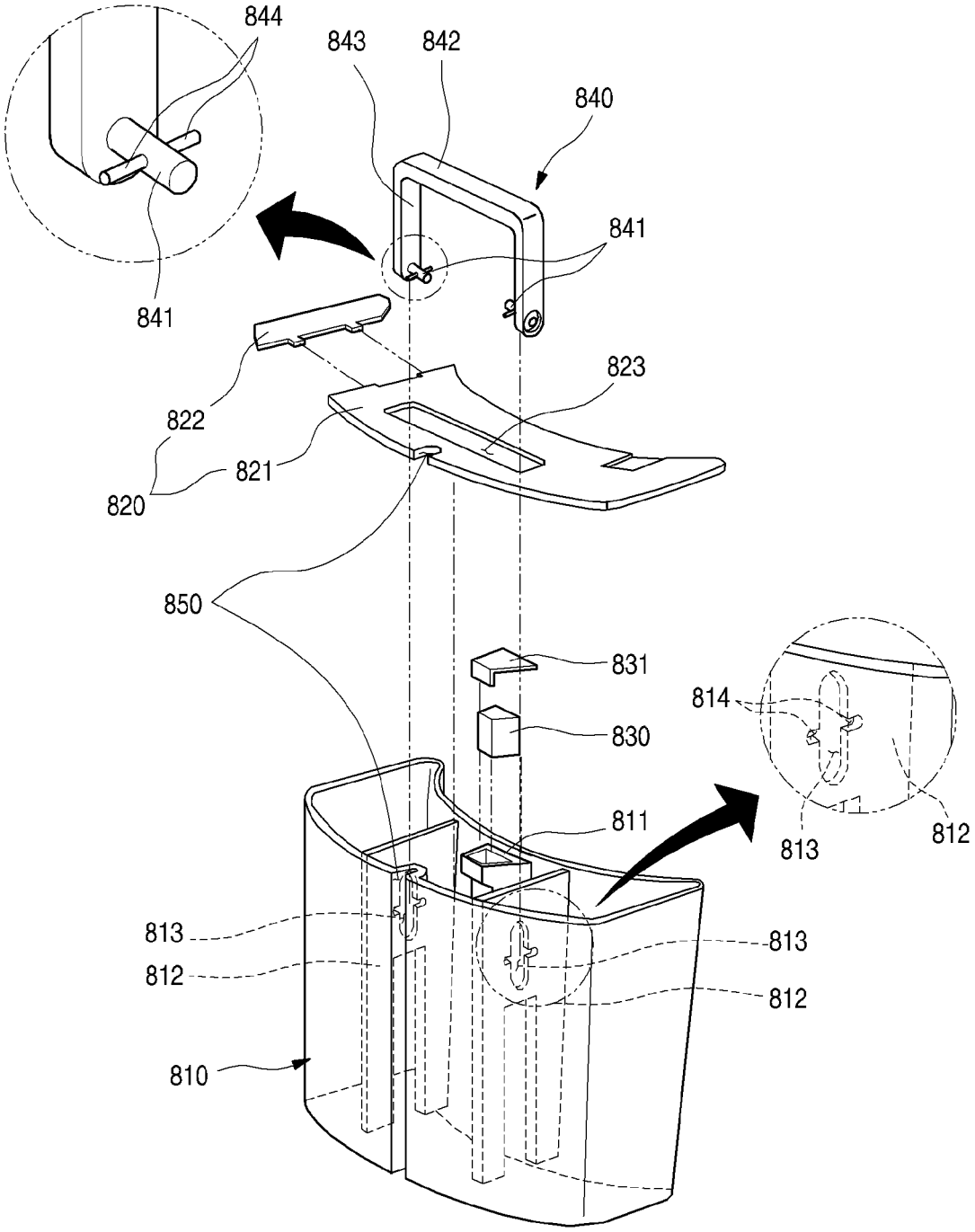
FIG. 12 is an exploded perspective view of the water tank of FIG. 11.

FIG. 11 is a perspective view of a water tank of the water tank assembly of FIG. 9. FIG. 12 is an exploded perspective view of the water tank of FIG. 11.

Referring to FIGS. 11 and 12, the water tank 800 may have a shape corresponding to an inner shape of the accommodation portion 730. The water tank 800 may include a lower transparent water collection portion 810, and an upper water collection portion cover 820.

In detail, the water collection portion 810 may be formed of a transparent acrylic or plastic material so that the inside of the water tank 800 may be seen from the outside, and the water collection portion 810 may be easily molded. A floater accommodation portion 811 to accommodate the floater 830 may be disposed inside the water collection portion 810. The floater accommodation portion 811 may be opened in an upward direction and define an independent space. Also, the floater accommodation portion 811 may be disposed lengthwise in a vertical direction to secure a moving path of the floater 830 and maintain the same water level as the inside of the water tank 800. The floater 830 may be accommodated in the floater accommodation portion 811. The floater 830 may vertically move according to a water level.

The floater accommodation portion 811 may be disposed at a position corresponding to the full level detector 660. Thus, a position of the floater 830, which may include a magnet therein and move along the floater accommodation portion 811, may be detected by a sensor of the full level detector 660. The opened top surface of the floater accommodation portion 811 may be covered by a floater cover 831 to prevent the floater 830 from being lost and locate or return the floater 830 within the floater accommodation portion 811.

A pair of handle mounts 812 may be disposed within the water tank 800. A tank handle 840 to be grasped by a user to move the water tank 800 may be disposed on the pair of handle mounts 812. A mounting hole 813 defined lengthwise in a vertical direction may be defined in each handle mount 812.

An insertion groove 814, which may be bisectionally cut, may be further defined in each mounting hole 813. When a mounting protrusion 841, which will be described hereinbelow, is inserted, a restricter 844 of the mounting protrusion 841 may be inserted into the insertion groove 814. The mounting protrusion 841 may be inserted through the mounting hole 813, and a mounted state of the tank handle 840 may be maintained by the restricter 844.

The mounting protrusion 841 of the tank handle 840 may be inserted into the mounting hole 813, and the tank handle 840 may vertically move along the mounting hole 813. The restricter 844 that protrudes laterally may be disposed on each of both sides of the mounting protrusion 841. The restricter 844 may have a shape which is insertable into the insertion groove 814. The mounting protrusion 841 may be restricted to be maintained in a state in which it is inserted in the mounting hole 813.

Thus, when the user separates or moves the water tank 800, the tank handle 840 may be withdrawn in an upward direction. When the water tank 800 is mounted on the water drawer 710, the tank handle 840 may move in a downward direction to insert the water handle 840 into the upper water collection portion cover 820.

The upper water collection portion cover 820 may cover the opened top surface of the water collection portion 810. The upper water collection portion cover 820 may include a cover 821 that covers the top surface of the water collection portion 810, and an opening 822 rotatably disposed on or at one side of the cover 821 to open a portion of the top surface of the water collection portion 810.

Thus, when the water filled into the water collection portion 810 is discarded, the opening 822 may rotate to open only a portion of the opened upper portion of the water collection 810, thereby allowing a user to discarding the water within the water collection portion 810, or the upper water collection portion cover 820 may be separated to discard the water.

A handle hole 823 may be defined in the upper water collection portion cover 820. The handle hole 823 may have a size corresponding to a horizontal size of the tank handle 840 to define a passage through which the tank handle 840 may be inserted or withdrawn.

The tank handle 840 may include a grasp 842 to be grasped by the user, and an extension 843 that extends in a downward direction from each of both ends of the grasp 842. The mounting protrusion 841 that protrudes inward may be disposed on a lower end of the extension 843. The mounting protrusion 841 may vertically move along the mounting hole 813 defined in the water collection portion 810.

When the tank handle 840 is not used, the tank handle 840 may move in the downward direction. In a state in which the tank handle 840 is completely inserted, the tank handle 840 may be inserted so that a top surface of the tank handle 840 may be disposed on a same plane as a top surface of the upper water collection portion cover 820.

A locker groove 850 recessed in a backward direction may be defined lengthwise in a vertical direction in each of centers of the water collection portion 810 and the upper water collection portion cover 820. When the water tank 800 is mounted, the locker 721 may be inserted into the locker groove 850. That is, the locker 721 may be inserted into the locker groove 850 in a state in which the water tank 800 is mounted on the accommodation portion 730 to prevent the water tank 800 from moving. Also, when the water tank 800 is inserted or withdrawn, the locker 721 may move along the locker groove 850.

Hereinafter, an operation of the dehumidifier according to embodiments having the above-described structure will be described hereinbelow.

First, to operate the dehumidifier 1, a user may locate the dehumidifier 1 in a space to be dehumidified. As the dehumidifier 1 may include the wheel 12 on the bottom surface thereof and the handle 40 on both sides of the top surface thereof, the dehumidifier 1 may be easily moved even though the dehumidifier 1 has a large size. A user may insert a hand thereof into each handle hole 111 defined in the top surface of the cover plate 110 to grasp the handle 40 through the space defined in a side of the side deco 400, thereby stably moving the dehumidifier 1.

When the dehumidifier 1 is located at a specific position, the user may manipulate the dehumidifier 1 to drive the dehumidifier 1. As the dehumidifier 1 is manipulated, the compressor 20 and the motor 530 may operate, and the louver 130 may rotate to expose the discharge holes 131 to the outside.

As the compressor 20 operates, refrigerant may flow through a refrigerant cycle. The compressor 20 may discharge a high-temperature, high-pressure liquid refrigerant. The evaporator may be cooled by low-temperature cool air introduced into the evaporator via the expansion device. Also, the refrigerant heat-exchanged with the external air in the evaporator to change in phase may flow toward the condenser. Then, the refrigerant may be heat-exchanged again in the condenser to return to the compressor 20. Thus, the evaporator may be continuously cooled, and the condenser may be heated due to the above-described refrigerant cycle.

The blowing fan 540 may rotate by operation of the motor 530. Thus, as the blowing fan 540 rotates, air of an indoor space in which the dehumidifier 1 is disposed may be forcibly suctioned into the dehumidifier 1 through the suction holes 331.

The suctioned air may pass through the evaporator. While the air passes through the evaporator, moisture contained in the air may be condensed while being heat-exchanged with the evaporator to flow along the evaporator. Also, the air passing through the evaporator may pass through the condenser. Then, the air heated by the condenser may change into dried air and then be introduced into the orifice 521. The air introduced into the orifice 521 may flow along the inner wall of the housing case 510 by the blowing fan 540 and be discharged again into the indoor space through the louver 130.

This process may be repeatedly performed until the humidity of the indoor space reaches a preset or predetermined humidity or according to a user's set preferences. Generated condensed water of the evaporator may be introduced into the water tank 800 through the drain passage 621 defined in the horizontal portion 620 of the frame 600. The condensed water introduced into the water tank 800 may be collected into the water collection portion 810. The condensed water may be continuously collected until reaching a preset or predetermined water level.

When an amount of water collected into the water tank 800 increases to reach the predetermined water level, the floater 830 may move upward. When a position of the floater 830 is detected by the water level sensor 661, the full level state may be indicated to the user using the display 152 so that the user may discard the water within the water tank 800. Also, when a position of the floater 830 is detected by the safety sensor 662, operation of the dehumidifier 1 may be stopped to prevent the water within the water tank 800 from overflowing.

The lighting module 670 may operate by a user's manipulation or be set during operation of the dehumidifier 1. When the lighting module 670 operates, the water tank 800 may emit light, such as indirect lighting, so that the water level of the water collected into the water tank 800 may easily be identified from the outside.

Hereinafter, an operation of the lighting module 670 will be described in more detail.

Figure 13:
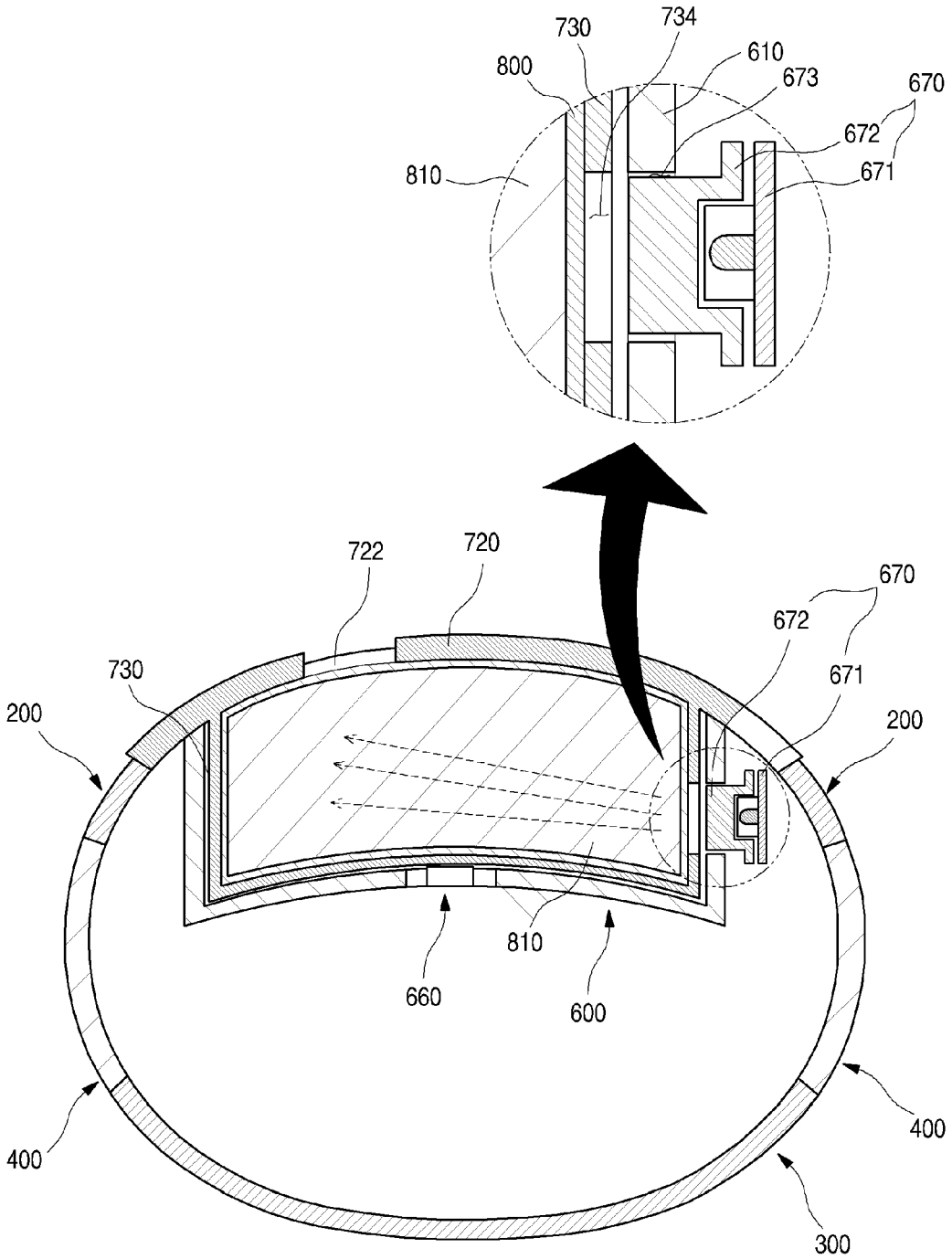
FIG. 13 is a cross-sectional view of a state in which light of a lighting module is irradiated into the water tank of FIG. 11.
Figure 14:
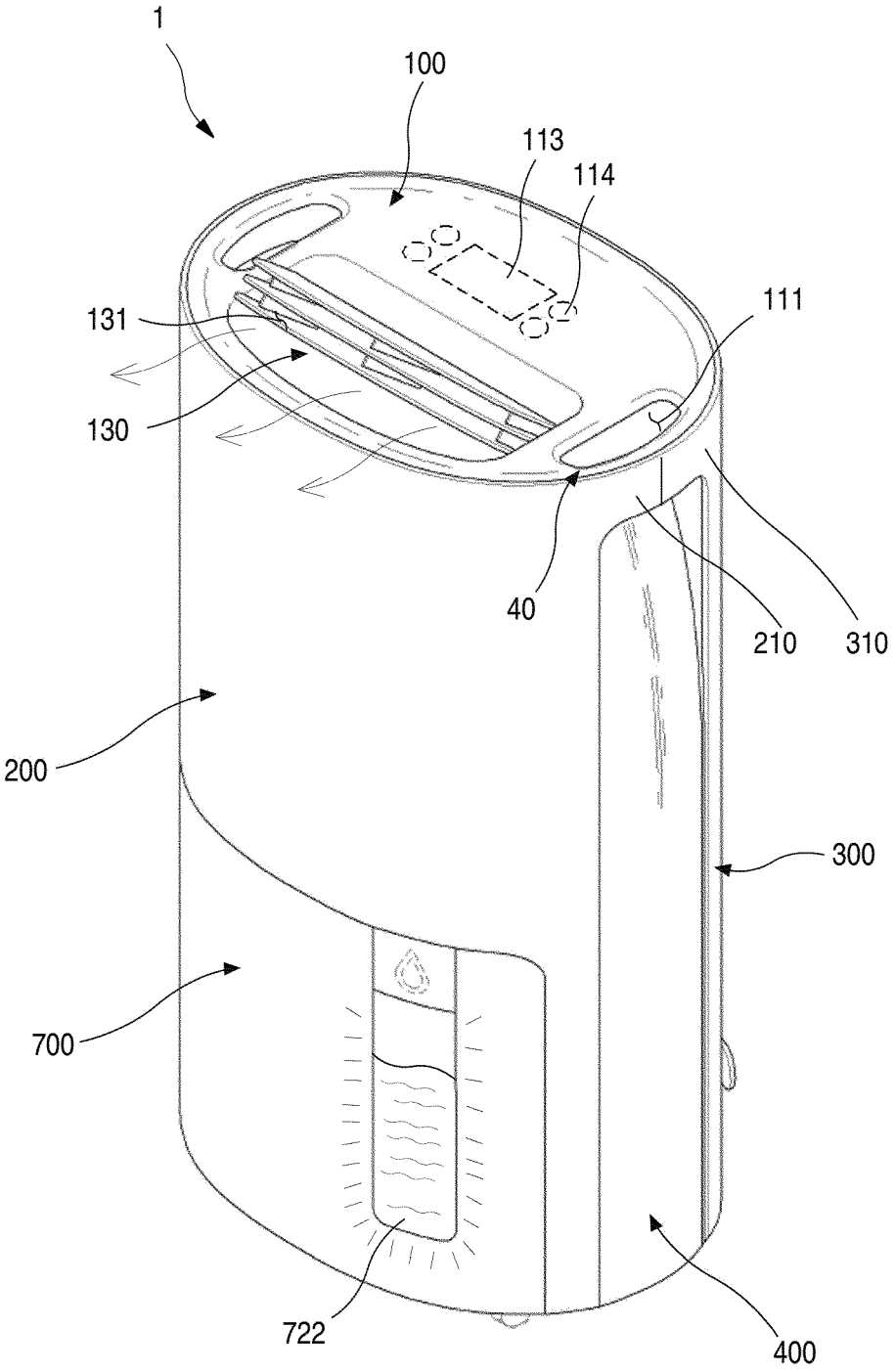
FIG. 14 is a view illustrating a state in which a water level of the water tank of FIG. 11 is visualized through an identification window in the water tank assembly.

FIG. 13 is a cross-sectional view of a state in which light of a lighting module is irradiated into the water tank of FIG. 11. FIG. 14 is a view illustrating a state in which a water level of the water tank of FIG. 11 is visualized through an identification window in the water tank assembly.

Referring to FIGS. 13 and 14, when the dehumidifier 1 operates, the lighting module 670 may operate according to a user's selection. When the operation of the lighting module 670 is set, light may be emitted from the light emitter 671. Then, the light may be reflected or refracted, and thus, emitted into the water tank 800 from one side of the water tank 800.

The light of the lighting module 670 may successively pass through the lighting hole 673 and the transmission portion 734 into the water tank 800, thereby lighting the inside of the water tank 800. The light may be emitted into the water tank 800 in a state in which water is collected into the water tank 800 due to the operation of the dehumidifier 1. Thus, the inside of the water tank 800 may be easily identified or viewed. Also, the state of the inside of the water tank 800 may be identified through the identification window 722 disposed on the front surface of the tank drawer 710.

Brightness between a portion filled with water and a portion not filled with water may be significantly different from each other due to the irradiated light. Thus, a user may identify a water level of the water tank 800. Also, even though the indoor space is dark, the inside of the water tank 800 may be easily identified or viewed.

In addition, when the indoor space is dark, the water tank 800 may brightly shine due to the operation of the lighting module 670. Also, the water tank 800 may function as indirect lighting, such as a mood lamp, using the water filled in the water tank 800. The lighting module 670 may emit light having various colors according to the operation of the dehumidifier 1.

For example, if the water level detected by the water level detector 660 is a normal water level, that is, in a state before the water level is detected by the water level sensor 661, the lighting module 670 may emit light having a blue color to allow the water tank 800 to glow in the blue color. Thus, the user may confirm that the water tank 800 changes into the blue color through the identification window 722. In this state, a user may recognize that it is unnecessary to empty the water tank 800.

When the water level of the water tank 800 is detected by the water level sensor 661, the lighting module 670 may emit light having a yellow color to allow the water tank 800 to glow in the yellow color. Thus, a user may confirm that the water tank 800 changes into the yellow color through the identification window 722. In this state, the user may recognize that the water tank 800 has to be emptied.

When the water level of the water tank 800 is detected by the safety sensor 662, the lighting module 670 may emit light having a red color to allow the water tank 800 to glow in the red color. Thus, a user may confirm that the water tank 800 changes into the red color through the identification window 722. In this state, the user may recognize that the water tank 800 is fully filled. It may be understood that, in this state, the dehumidifier 1 does not perform the dehumidifying operation any more. Thus, in this state, the user has to immediately discard the water within the water tank 800 and then manipulate the dehumidifier 1 to operate again.

As described above, even though the water level is not directly identified, the user may determine a time at which the water tank 800 has to be emptied using only the color identified through the identification window 722.

A process for detaching the water tank 800 when it is detected that the water level of the water tank 800 has reached a full level, or it is necessary to discard the water within the water tank 800 will be described in detail hereinbelow with reference to the drawings.

Figure 15:
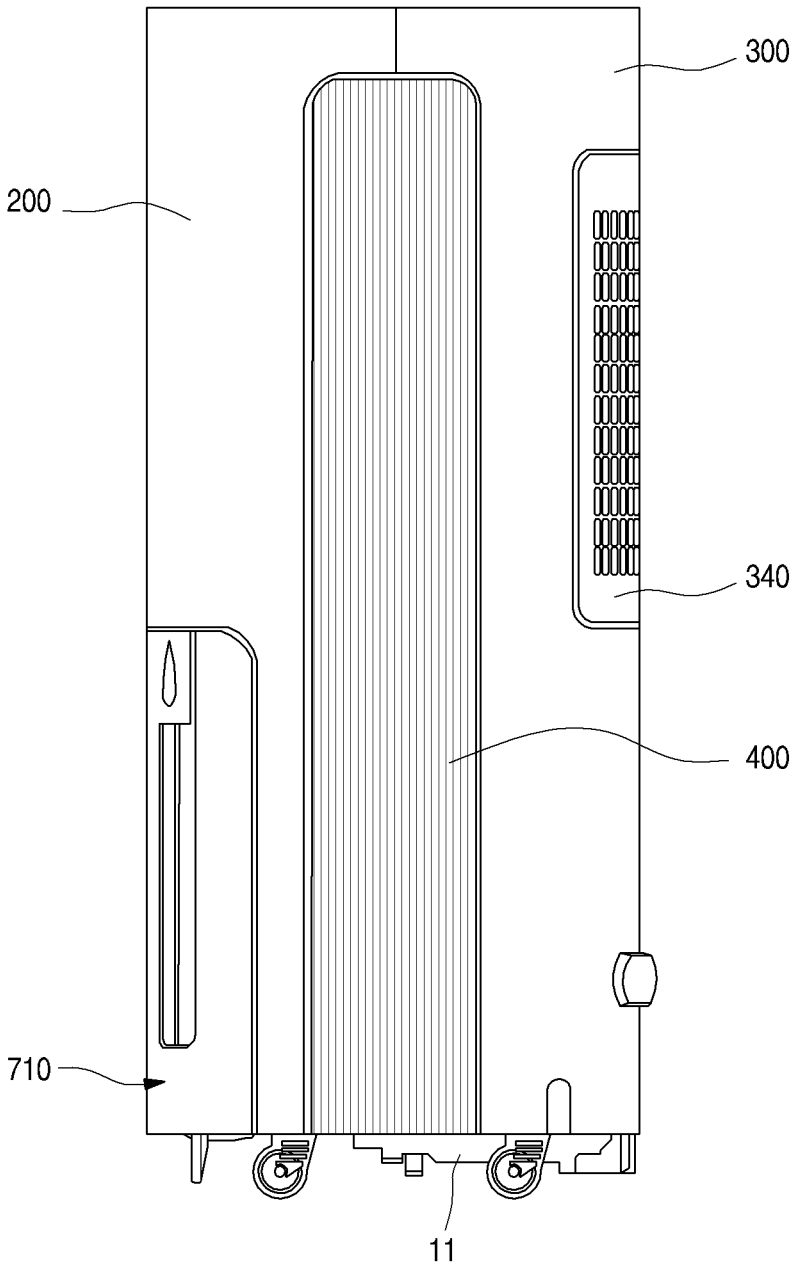
FIG. 15 is a side view of the dehumidifier of FIG. 1, before the water tank assembly is withdrawn.

FIG. 15 is a side view of the dehumidifier of FIG. 1, before the water tank assembly is withdrawn. Referring to FIG. 15, before the dehumidifier 1 operating normally reaches the full level of the water tank 800, the tank drawer 710 may be maintained in the closed state. When the tank drawer 710 is closed, the front surface of the tank drawer 710 may be disposed on the same plane as the front case 200 to realize a sense of unity. In this state, the roller 680 may be disposed at the rearmost position of the main guide 630, and the sub roller 690 may also be disposed at the rearmost position of the sub guide 640. Also, in the state in which the locker 721 is inserted into the latch 650, the tank drawer 710 may be maintained in the closed state by the restriction between the locker 721 and the latch 650.

Figure 16:
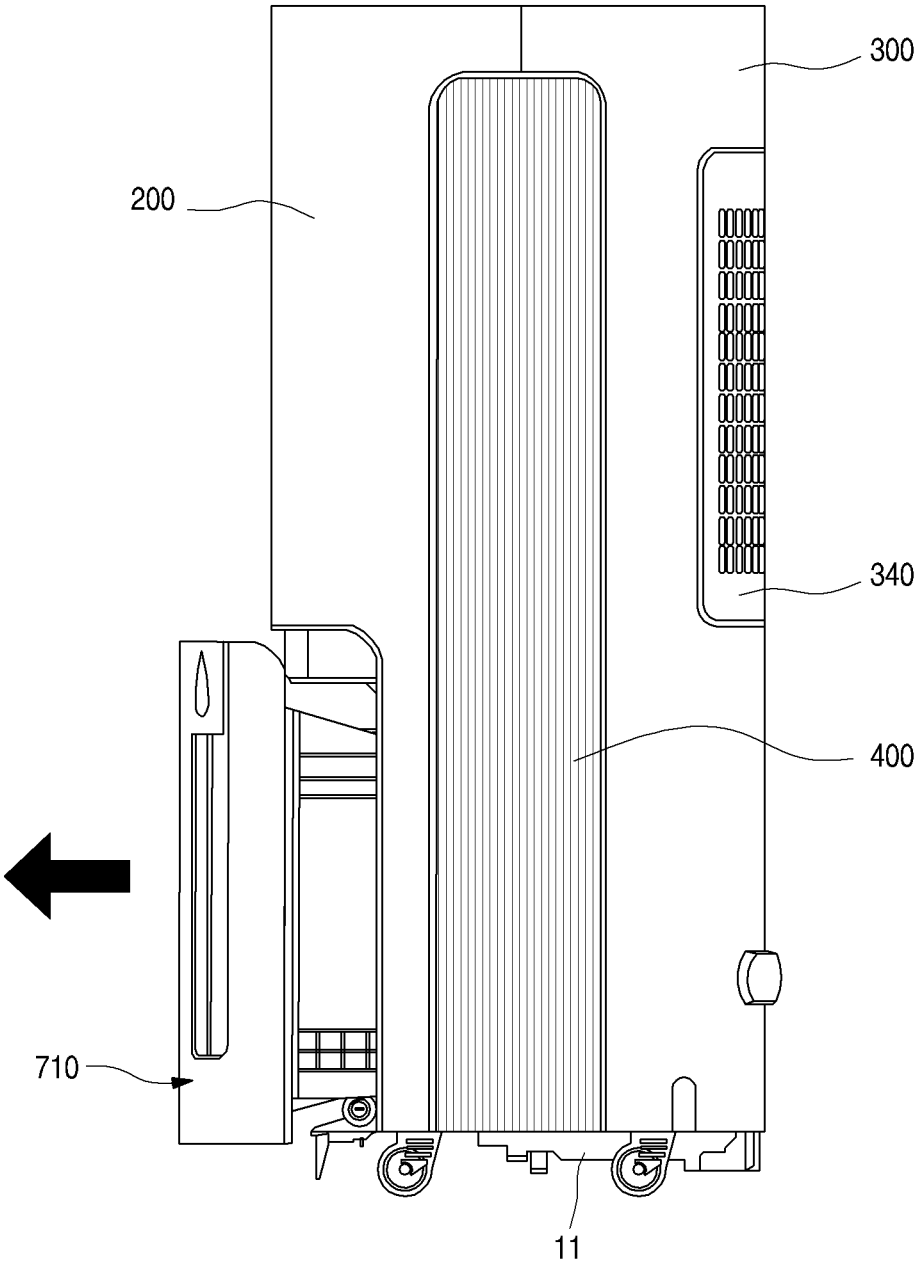
FIG. 16 is a side view of the dehumidifier of FIG. 1, in a state in which the water tank assembly is withdrawn.
Figure 17:
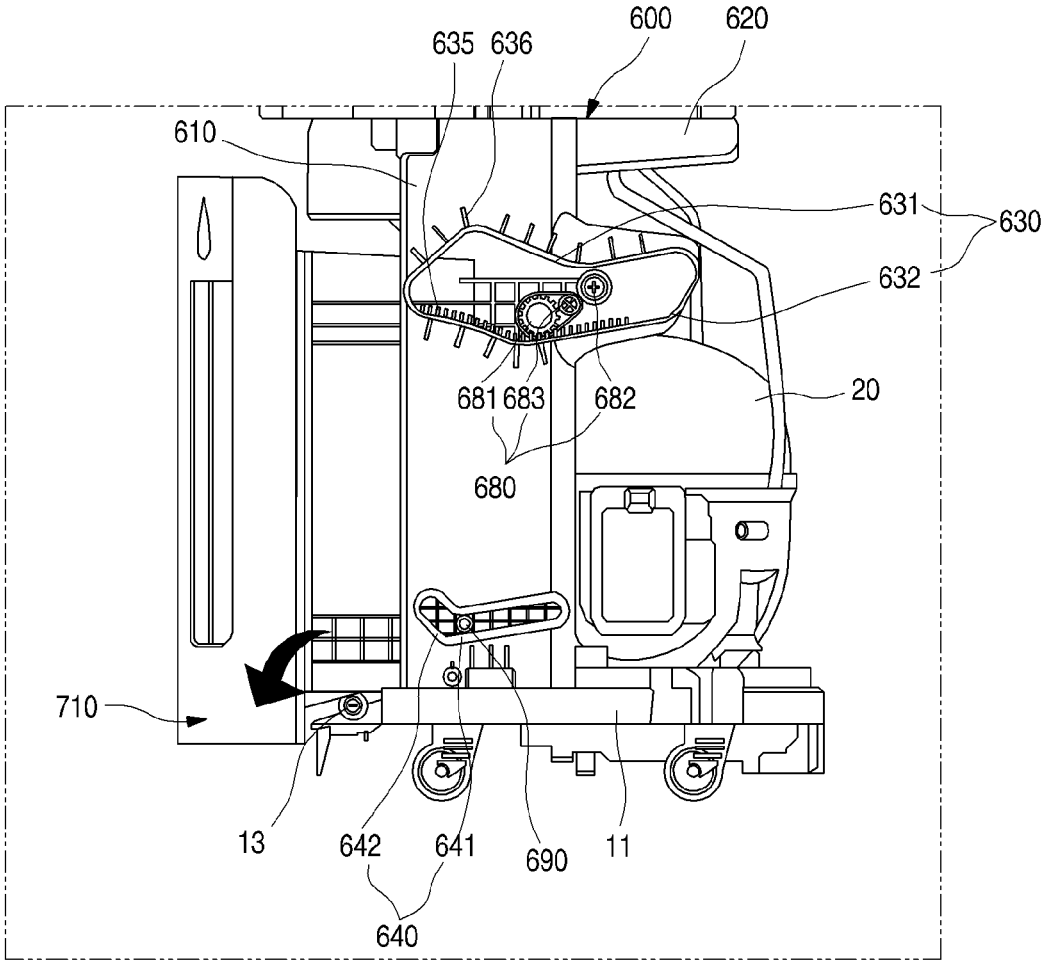
FIG. 17 is a side view of the guide assembly of FIG. 10, in a state in which the water tank assembly is withdrawn.

FIG. 16 is a side view of the dehumidifier of FIG. 1, in a state in which the water tank assembly is withdrawn. FIG. 17 is a side view of the guide assembly of FIG. 10, in a state in which the water tank assembly is withdrawn.

Referring to FIGS. 16 and 17, to discard the water within the water tank 800, a user may push an upper portion of the tank drawer 710 in a backward direction and then release it by pushing the upper portion of the tank drawer 710 disposed to correspond to the locker 721 to release the restriction between the latch 650 and the locker 721. When the restriction between the latch 650 and the locker 721 is released, the roller 681 of the roller 680 may rotate while moving along the gear 635 disposed on the main guide 630. As the roller 681 moves along the downward tilted portion 633, which is tilted in the downward direction, the tank drawer 710, in which the water tank 800 is accommodated, may be automatically withdrawn by a self-weight thereof.

The damper 683 interlocked with the roller gear 681 may prevent the rotation rate of the roller gear 681 from significantly increasing so that the tank drawer 710 may be withdrawn in the forward direction at a range of a constant rate.

The main roll 682 may roll along the upper portion 631 in the state in which the main roller 682 contacts the upper portion 631 of the main guide 630 to prevent the tank drawer 710 from vertically moving so that the roller gear 681 stably moves along the gear 635 while the tank drawer 710 is withdrawn. The sub roller 690 may roll along the sub guide 640 to move along the downward tilt of the withdrawal portion 641 of the sub guide 640.

As described above, the tank drawer 710 may be slidably withdrawn forward to the state of FIGS. 16 and 17.

Figure 18:
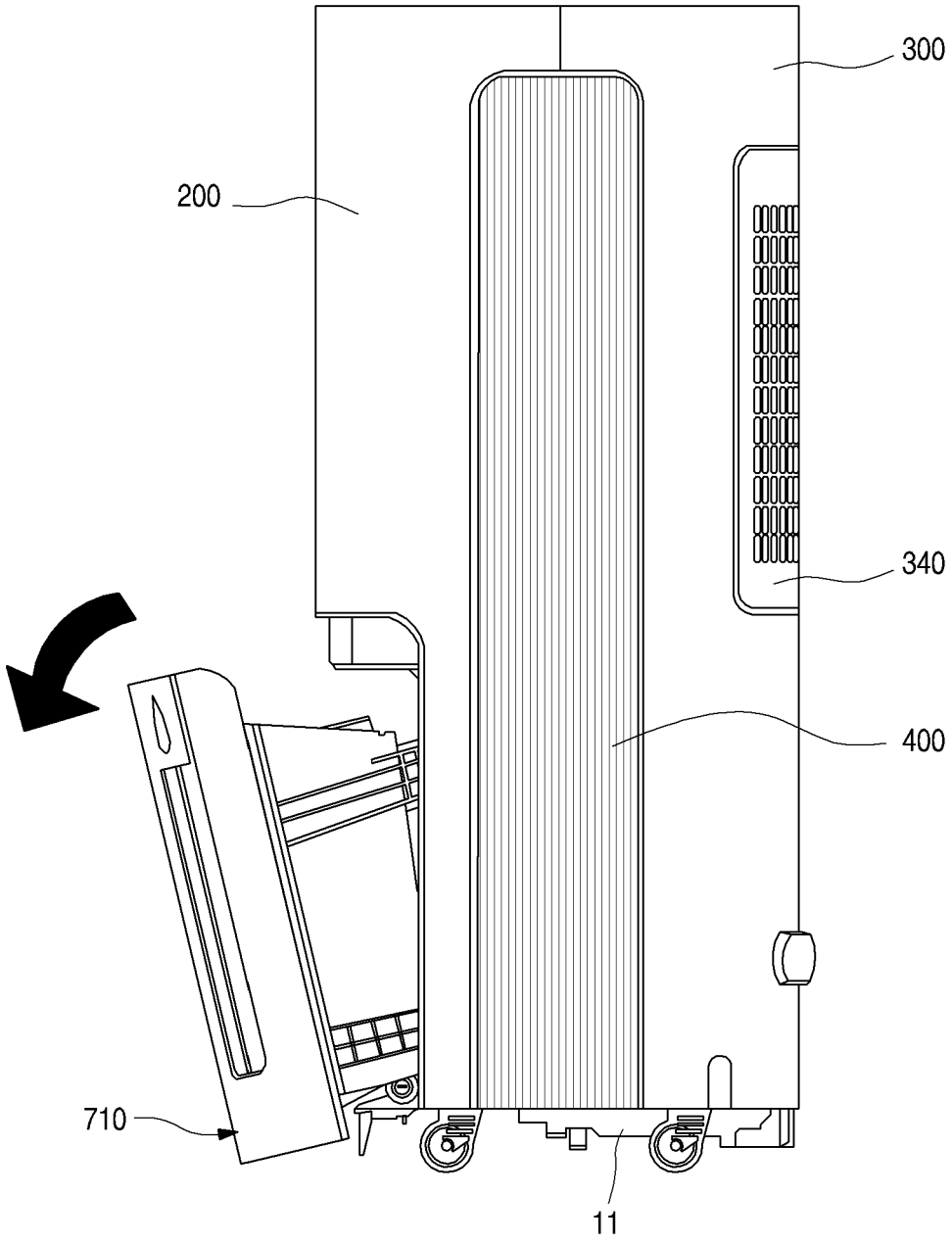
FIG. 18 is a side view of the dehumidifier of FIG. 1, in a state in which the water tank assembly is tilted after being withdrawn.
Figure 19:
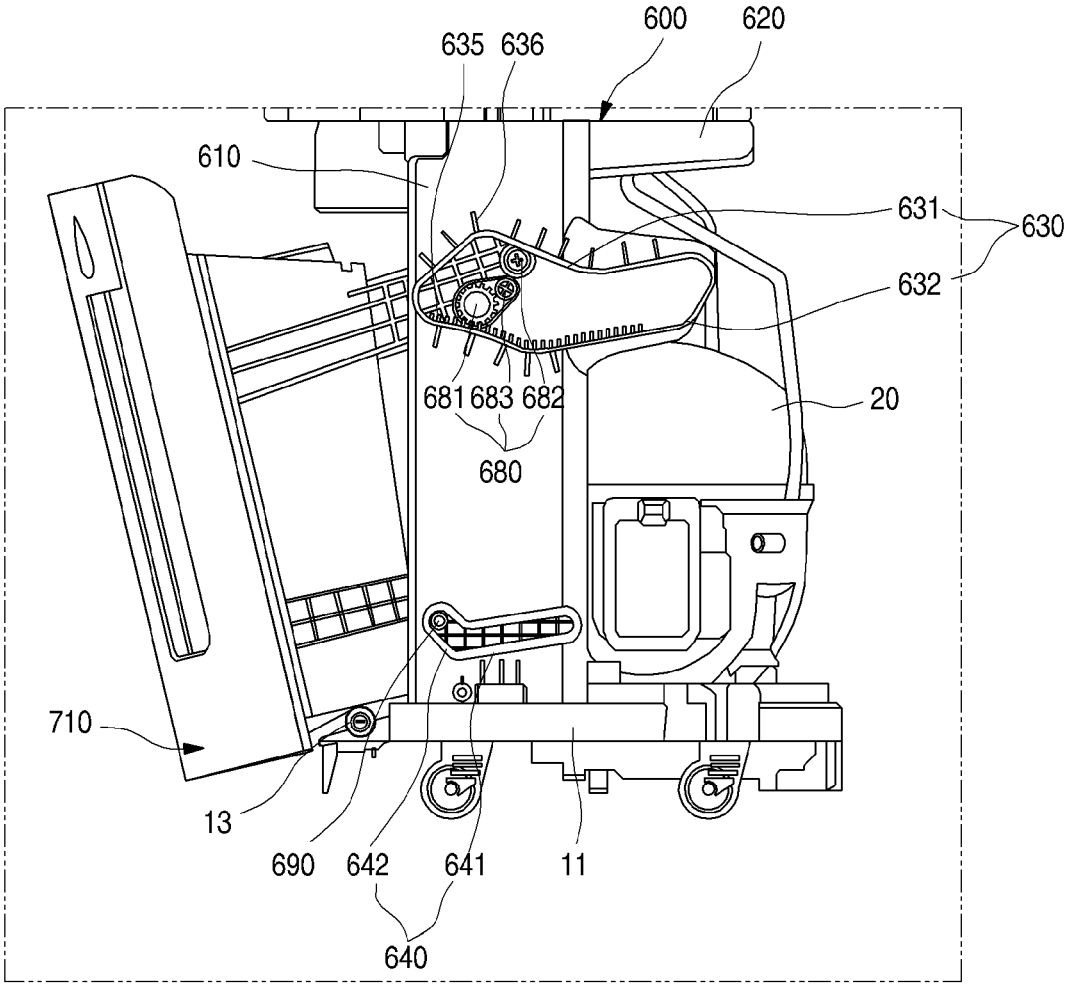
FIG. 19 is a side view of the guide assembly of FIG. 10, in a state in which the water tank assembly is tilted after being withdrawn.

FIG. 18 is a side view of the dehumidifier of FIG. 1, in a state in which the water tank assembly is tilted after being withdrawn. FIG. 19 is a side view of the guide assembly of FIG. 10, in a state in which the water tank assembly is tilted after being withdrawn.

Referring to FIGS. 18 and 19, the tank drawer 710 may move in the forward direction at a maximum rate at a time point at which the roller gear 681 moves out of the downward tilt. Then, the roller gear 681 may move along the upward tilted portion 634 due to forward moving inertia.

The roller gear 681 may move in a state in which the roller gear 681 is continuously coupled to the gear 635 of the upward tilted portion 634. The moving rate of the rolling gear 681 may gradually decrease due to the upward tilt of the upward tilted portion 634. The main roller 682 may be rolled along the upper portion 631 in the state in which the main roller 682 continuously contacts the upper portion 631 to prevent the roller gear 681 from being separated.

While the roller gear 681 moves, the sub roller 690 may be inserted into the tilting portion 642 and rolled. A moving distance of the tilting portion 642 may be relatively shorter than a moving distance of the upward tilted portion 634.

The tank drawer 710 may be supported by the base roller 13 disposed on the base pan 11. When the tank drawer 710 is maximally withdrawn, a weight center may be defined at a front side of a position of the tank drawer 710 supported by the base roller 13 to generate a moment. Thus, the tank drawer 710 may be tilted while smoothly rotating.

The roller 680 and the sub roller 690 may guide the tilting of the tank drawer 710 while moving along the main guide 630 and the sub guide 640. Also, the tank drawer 710 may be tilted to completely expose the opened top surface of the accommodation portion 730 upward.

When the tank drawer 710 is completely tilted, the states of FIGS. 18 and 19 may be realized. The roller 680 and the sub roller 690 may be disposed at the foremost positions of the main guide 630 and the sub guide 640, respectively.

Figure 20:
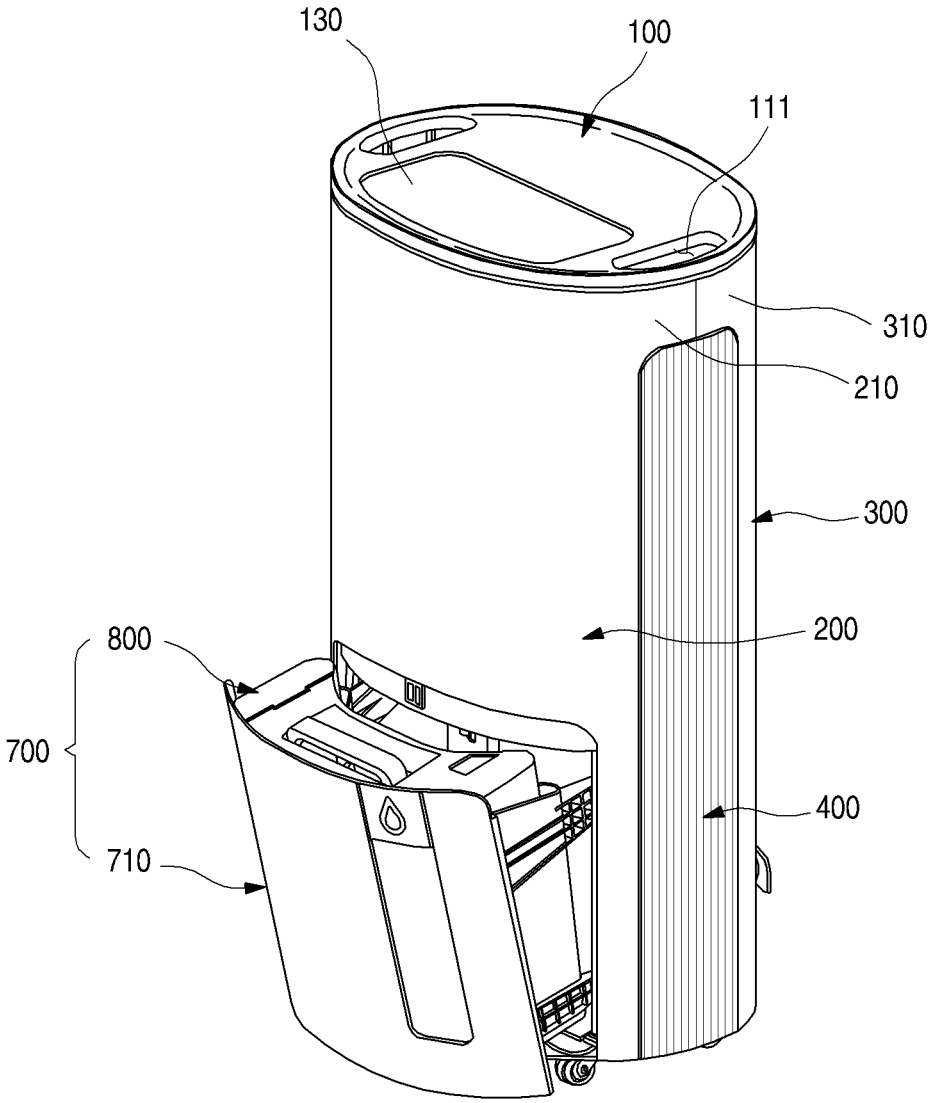
FIG. 20 is a perspective view illustrating a state in which a tank drawer of the water tank assembly of FIG. 10 is withdrawn.
Figure 21:
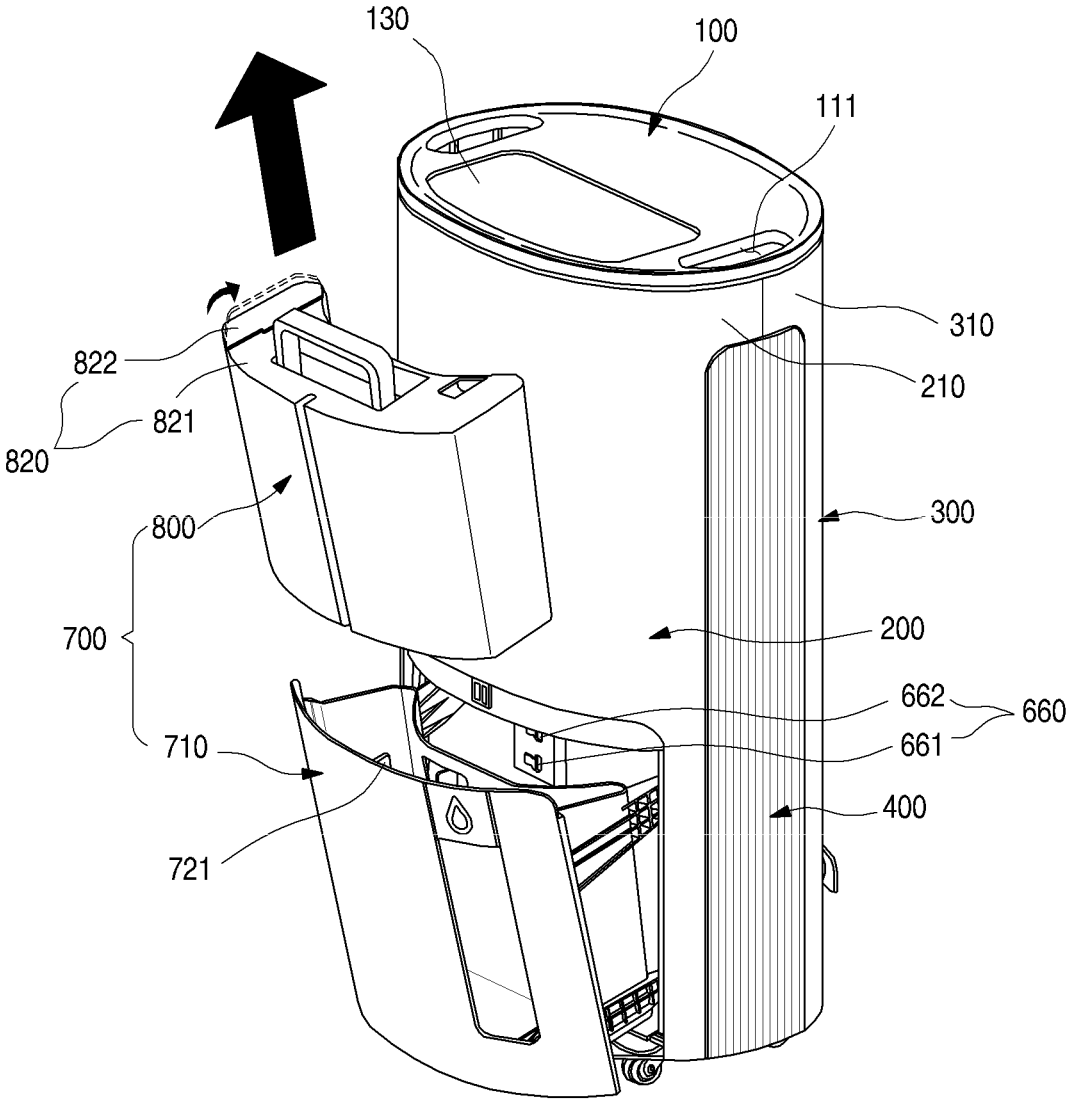
FIG. 21 is a perspective view illustrating a state in which the water tank of FIG. 11 is separated from the tank drawer of FIG. 20.

FIG. 20 is a perspective view illustrating a state in which the tank drawer of the water tank assembly of FIG. 10 is withdrawn. FIG. 21 is a perspective view illustrating a state in which the water tank is separated from the tank drawer of FIG. 10.

Referring to FIGS. 20 and 21, if it is intended to discard the water within the water tank 800 when the water tank 800 is fully filled with water, the tank drawer 710 may be withdrawn and tilted as illustrated in FIG. 20. In this state, the top surface of the water tank 800 may be exposed to the outside, and the tank handle 840 of the water tank 800 inserted. The water tank 800 accommodated into the tank drawer 710 has to be withdrawn to discard the water collected into the water tank 800. Thus, a user may grasp the tank handle 840 to lift the water tank 800 upward, thereby withdrawing the water tank 800.

When the tank handle 840 is grasped and lifted in the upward direction, the tank handle 840 may be withdrawn in the upward direction while moving in the upward direction. The tank handle 840 may be withdrawn until the mounting protrusion 841 is disposed at an end of the mounting hole 813.

In a state in which the tank handle 840 is fully withdrawn, the user may lift the water tank 800 in the upward direction.

The water tank 800 may be withdrawn from the accommodation portion 730 of the tank drawer 710.

To stably withdraw the water tank 800, the water tank 800 may move upward along the locker 734 and the locker groove 850. Thus, the water tank 800 may be stably withdrawn in the upward direction without moving horizontally.

After the water tank 800 is completely withdrawn, the user may move the water tank in the state in which the user grasps the tank handle 840. The user may move the high-capacity water tank 800 using only one hand.

Also, after the opening 822 of the water tank 800 rotates to open so as to discard the water within the water tank 800, the user may grasp the tank handle 840 to tilt the water tank 800, thereby discarding the water within the water tank 800. After the water within the water tank 800 is completely emptied, the opening 822 may be closed, and then the water tank 800 may be accommodated again into the tank drawer 710. The water tank 800 may be stably mounted inside the tank drawer 710 by the locker 734 and the locker groove 850.

Also, when the tank handle 840 is released after the water tank 800 is accommodated in the tank drawer 710, the tank handle 840 may be inserted or reinserted into the water tank 800 by the self-weight thereof. When the tank handle 840 is completely inserted, the user may insert the tank drawer 710 again into the main body of the dehumidifier 1 to perform the operation of the dehumidifier 1.

According to a dehumidifier and a water tank for a dehumidifier according to embodiments, the handle inserted into or withdrawn from the water tank may be disposed on the top surface of the water tank in which the condensed water may be collected. Thus, in a state in which the water tank is mounted on the dehumidifier, as the handle may be mounted on the dehumidifier in a state in which the handle is inserted, the handle may not be exposed to the outside, preventing an outer appearance of the dehumidifier from being deteriorated.

Also, when the water tank is separated from the dehumidifier, the handle may be pulled and then withdrawn. Thus, a water tank having a large capacity may be easily moved, and also, may be easily tilted to discard the water therein.

As the handle is inserted or withdrawn in the vertical direction with respect to the top surface of the water tank, the water tank may be withdrawn by only lifting the water tank without performing separate manipulation. Also, when the water tank is inserted after being used, the water tank may be inserted by the self-weight thereof to realize a simple manipulation.

Embodiments disclosed herein provide a dehumidifier in which a withdrawable handle is provided on a water tank that collects condensed water, and thus, when the water tank is mounted, the water tank may be mounted in a state in which the handle is inserted, and when the water tank is withdrawn or moved, the handle may be withdrawn to improve convenience in use.

Embodiments disclosed herein provide a dehumidifier that may include a main body, in which a heat exchange module or heat exchanger may be disposed; a frame disposed in the main body and on which the heat exchange module may be seated; a tank drawer slidably inserted and withdrawn along a guide disposed on the frame; a water tank accommodated into the tank drawer to collect condensed water generated in the heat exchange module; and a tank handle disposed on the water tank so that the tank handle may be inserted into and withdrawn from the water tank, the tank handle being grasped by a user. The water tank may be accommodated through an open top surface of the tank drawer.

A locker, which may be restricted in a state in which the tank drawer is closed, may be disposed on a back surface of the tank drawer. A locker groove that extends from an upper end to a lower end of the water tank and into which the locker may be accommodated when the water tank is mounted may be defined.

The tank handle may be inserted up to a same plane as a top surface of the water. The tank handle may be inserted and withdrawn in a same direction as a detachable direction of the water tank. When the tank drawer is withdrawn, the tank handle may be exposed through an open upper side of the tank drawer.

Embodiments disclosed herein further provide a water tank for a dehumidifier, which may store moisture of suctioned air condensed by a heat exchanger disposed inside a main body that may include a water collection part or portion detachably disposed on the main body, the water collection part having a space in which the condensed water of the heat exchanger may be stored; a water collection part cover that covers an open top surface of the water collection part; and a tank handle disposed to pass through the water collection part cover, the tank handle being inserted into and withdrawn from the water collection part.

A handle mounting part or mount that guides sliding of the tank handle may be further disposed inside the water collection part. The handle mounting part may be disposed to cross an inside of the water collection part.

A mounting protrusion may protrude from a lower end of each of both sides of the tank handle, and a mounting hole lengthily defined in a vertical direction inside the water collection part and through which the mounting protrusion vertically moves in a state in which the mounting protrusion is inserted into the mounting hole may be further defined inside the water collection part.

An insertion groove that extends in both directions may be defined in one side of the mounting hole, and a restriction part or restricter that laterally extends to be inserted into the insertion groove may be further disposed on each of both sides of the mounting protrusion. The tank handle may be inserted and withdrawn in a detachable direction of the water tank.

The water collection cover may include a cover part or cover mounted on an upper end of the water collection part to cover a portion of the open top surface of the water collection part and through which the tank handle may pass and an opening part or opening rotatably mounted on one end of the cover part to selectively open the remaining portion of the open top surface of the water collection part. The tank handle may be disposed on a same plane as a top surface of the water collection part cover.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dehumidifier, comprising:

a main body in which a heat exchanger is provided;

a frame provided in the main body and on which the heat exchanger is seated;

a tank drawer slidably inserted and withdrawn along at least one guide provided on the frame;

a water tank accommodated in the tank drawer to collect condensed water generated in the heat exchanger; and a tank handle provided on the water tank so that the tank handle is inserted into and withdrawn from the water tank, the tank handle being configured to be grasped by a user to move the water tank, wherein the water tank includes:

a water collection tank detachably provided on the main body; and a water collection tank cover that covers an open top surface of the water collection tank, wherein a handle hole is defined in the water collection tank cover, wherein the tank handle passes through the handle hole to be inserted into and withdrawn from the water collection tank, wherein the tank handle includes a grasp to be grasped by the user and a pair of extensions that extends in a downward direction from ends of the grasp, wherein the water tank has a space in which the condensed water of the heat exchanger is stored and the pair of extensions is accommodated, wherein a pair of handle mounts that guides sliding of the pair of extensions is provided inside of the water collection tank to cross an inside of the water collection tank, and wherein the pair of handle mounts is spaced apart from side end plates of the water collection tank cover.

2. The dehumidifier according to claim 1, wherein the tank drawer includes an opened top surface through which the water tank is inserted into and withdrawn from the tank drawer.

3. The dehumidifier according to claim 1, further including a locker, which is restricted in a state in which the tank drawer is closed, provided on a back surface of the tank drawer.

4. The dehumidifier according to claim 3, further including a locker groove that extends from an upper end to a lower end of the water tank and into which the locker is accommodated when the water tank is mounted.

5. The dehumidifier according to claim 1, wherein the grasp is inserted into the water tank up to a same plane as a top surface of the water tank.

6. The dehumidifier according to claim 1, wherein the tank handle is inserted and withdrawn in a same direction as a detachable direction of the water tank from the tank drawer.

7. The dehumidifier according to claim 1, wherein the tank drawer includes an opened upper side, and when the tank drawer is withdrawn, the grasp is exposed through the opened upper side of the tank drawer.

8. A water tank for a dehumidifier that stores moisture of suctioned air condensed by a heat exchanger provided inside a main body, the water tank comprising:

a water collection tank detachably provided on the main body;

a water collection tank cover that covers an open top surface of the water collection tank; and a tank handle, wherein a handle hole is defined in the water collection tank cover, wherein the tank handle passes through the handle hole to be inserted into and withdrawn from the water collection tank, wherein the tank handle includes a grasp to be grasped by the user and a pair of extensions that extends in a downward direction from ends of the grasp, wherein the water tank has a space in which the condensed water of the heat exchanger is stored and the pair of extensions is accommodated, wherein a pair of handle mounts that guides sliding of the pair of extensions is provided inside of the water collection tank to cross an inside of the water collection tank, and wherein the pair of handle mounts is spaced apart from side end plates of the water collection tank cover.

9. The water tank according to claim 8, wherein the tank handle further includes a pair of mounting protrusions that protrudes from a lower end of each of both sides of the tank handle, respectively, and the water collection tank further includes a pair of mounting holes that extends lengthwise in a vertical direction and through which the pair of mounting protrusions vertically moves in a state in which the pair of mounting protrusions is inserted into the pair of mounting holes, respectively.

10. The water tank according to claim 9, wherein an insertion groove that extends in both directions is defined in the mounting hole, and wherein a restricter that laterally extends to be inserted into the insertion groove is further provided on each of both sides of each mounting protrusion.

11. The water tank according to claim 8, wherein the tank handle is inserted and withdrawn in a detachable direction of the water tank from the dehumidifier.

12. The water tank according to claim 8, wherein the water collection tank cover includes:

a cover mounted on an upper end of the water collection tank to cover a first portion of the opened top surface of the water collection tank; and an opening rotatably mounted on one end of the cover to selectively open a second portion of the opened top surface of the water collection tank, wherein the handle hole is defined in the cover.

13. The water tank according to claim 8, wherein the tank handle is provided on a same plane as a top surface of the water collection tank cover.

14. A dehumidifier including the water tank of claim 8.

15. A dehumidifier, including:

a main body in which a heat exchanger is provided;

a frame provided in the main body and on which the heat exchanger is seated;

a tank drawer slidably inserted and withdrawn along at least one guide provided on the frame;

a water tank accommodated in the tank drawer to collect condensed water generated in the heat exchanger; and a tank handle provided on the water tank, wherein the tank handle is movable between an inserted position in which an upper surface of the tank handle is flush with an upper surface of the tank top cover and a withdrawn position at which the upper surface of the tank handle is elevated above the tank top cover such that the tank handle is graspable by a user to move the water tank, wherein the water tank includes:

a water collection tank detachably provided on the main body; and a water collection tank cover that covers an open top surface of the water collection tank, wherein a handle hole is defined in the water collection tank cover, wherein the tank handle passes through the handle hole to be inserted into and withdrawn from the water collection tank, wherein the tank handle includes a grasp to be grasped by the user and a pair of extensions that extends in a downward direction from ends of the grasp, wherein the water tank has a space in which the condensed water of the heat exchanger is stored and the pair of extensions is accommodated, wherein a pair of handle mounts that guides sliding of the pair of extensions is provided inside of the water collection tank to cross an inside of the water collection tank, and wherein the pair of handle mounts is spaced apart from side end plates of the water collection tank cover.

16. The dehumidifier according to claim 15, wherein the tank drawer includes an opened top surface through which the water tank is inserted into and withdrawn from the tank drawer.

17. The dehumidifier according to claim 15, wherein the tank drawer is configured to be withdrawn from the main body in a horizontal orientation by moving along the at least one guide and then be further withdrawn from the main body in a tilted orientation by moving further along the at least one guide.

18. The dehumidifier according to claim 15, wherein the water collection tank cover includes:

a cover mounted on an upper end of the water tank to cover a first portion of the opened top surface of the water tank and through which the tank handle passes; and an opening rotatably mounted on one end of the cover to selectively open a second portion of the opened top surface of the water tank, wherein the handle hole is defined in the cover.

19. The dehumidifier according to claim 1, wherein the handle hole has a size corresponding to a horizontal size of the tank handle to define a passage through which the tank handle is inserted or withdrawn, and wherein the pair of handle mounts guides the pair of extensions to be inserted so that a top surface of the grasp is provided on a same place as a top surface of the water collection tank cover.

20. The dehumidifier according to claim 1, wherein the at least one guide includes:

a main guide provided at an upper portion of the frame, the main guide defining a passage through which a roller assembly moves to slidably insert the tank drawer into the main body; and a sub guide provided at a lower portion of the frame, the sub guide being smaller than the main guide and defining a passage through which a sub roller on the tank drawer moves to slidably insert the tank drawer into the main body.

21. The dehumidifier according to claim 20, wherein the roller assembly includes:

a main roller provided on the tank drawer;

a roller gear that moves to slidably insert the tank drawer into the main body; and a damper that accommodates the roller gear to buffer a rotation rate and impact of the roller gear.

* * * * *